US010161151B2

(12) United States Patent
Goettl et al.

(10) Patent No.: US 10,161,151 B2
(45) Date of Patent: Dec. 25, 2018

(54) SWIMMING POOL SKIMMERS AND SKIMMER NOZZLE CONNECTORS

(71) Applicant: GSG Holdings, Inc., Chandler, AZ (US)

(72) Inventors: John M. Goettl, Phoenix, AZ (US); Dominic Conn, Tempe, AZ (US)

(73) Assignee: GSG Holdings, Inc., Chandler, AZ (US)

( * ) Notice: Subject to any disclaimer, the term of this patent is extended or adjusted under 35 U.S.C. 154(b) by 0 days.

(21) Appl. No.: 15/388,684

(22) Filed: Dec. 22, 2016

(65) Prior Publication Data

US 2017/0101796 A1 Apr. 13, 2017

Related U.S. Application Data

(63) Continuation-in-part of application No. 14/980,759, filed on Dec. 28, 2015, now Pat. No. 9,874,037, which is a continuation-in-part of application No. 14/496,201, filed on Sep. 25, 2014, now Pat. No. 9,593,500.

(60) Provisional application No. 61/882,544, filed on Sep. 25, 2013.

(51) Int. Cl.
*E04H 4/12* (2006.01)
*E04H 4/16* (2006.01)

(52) U.S. Cl.
CPC ..... *E04H 4/1272* (2013.01); *E04H 4/169* (2013.01)

(58) Field of Classification Search
CPC ..... E04H 4/1272; E04H 4/169
USPC ..... 210/167.1, 167.12, 167.19, 232, 416.1, 210/416.2
See application file for complete search history.

(56) References Cited

U.S. PATENT DOCUMENTS

| | | | | |
|---|---|---|---|---|
| 1,323,960 | A | 12/1919 | Burrill | |
| 1,476,029 | A | 12/1923 | Black | |
| 2,013,188 | A | 9/1935 | Reinhardt | |
| 2,439,282 | A | 4/1948 | Beckett | |
| 2,900,079 | A * | 8/1959 | Pace | F04D 29/708 210/167.12 |
| 2,940,467 | A | 6/1960 | Smith | |
| 3,067,879 | A * | 12/1962 | Baker | E04H 4/1272 137/398 |
| 3,616,916 | A * | 11/1971 | Greene | E04H 4/1272 210/121 |
| 3,877,482 | A | 7/1975 | Rawdon | |
| 3,895,645 | A | 7/1975 | Johnson | |
| 4,185,333 | A | 1/1980 | Ortega | |
| 4,230,142 | A | 10/1980 | Saarem et al. | |
| 4,342,125 | A | 8/1982 | Hodge | |

(Continued)

*Primary Examiner* — Fred Prince
(74) *Attorney, Agent, or Firm* — McCarter & English, LLP

(57) ABSTRACT

A pool skimmer including a skimmer housing and a venturi system is disclosed. The skimmer housing includes a pool throat opening, an angled pool throat extension. A pump inlet port into the skimmer housing includes an upper end and bayonet lugs, and an internally threaded surface between the bayonet lugs and the upper end of the pump inlet port. A nozzle comprises a nozzle housing with bayonets on an external surface of the nozzle housing, the bayonets releasably engaged with the bayonet lugs of the pump inlet port, wherein when the bayonets of the nozzle housing are in a fully tightened position in relation to the bayonet lugs of the pump inlet port, the at least a first nozzle is directed to spray toward the pool return port of the skimmer housing.

22 Claims, 24 Drawing Sheets

(56) References Cited

U.S. PATENT DOCUMENTS

| | | | | |
|---|---|---|---|---|
| 4,373,220 | A | 2/1983 | Selsted | |
| 4,431,024 | A | 2/1984 | Gallagher | |
| 4,600,031 | A | 7/1986 | Nestich | |
| 4,879,772 | A * | 11/1989 | Meloney, Jr. | E04H 4/06 210/167.1 |
| 5,830,350 | A | 11/1998 | Voss et al. | |
| 6,022,481 | A | 2/2000 | Blake | |
| 7,300,576 | B1 | 11/2007 | Blake | |
| 7,563,365 | B2 | 7/2009 | Pellington et al. | |
| 8,266,737 | B1 | 9/2012 | Goettl | |
| 2005/0000012 | A1 * | 1/2005 | Stetson | E04H 4/1272 4/508 |
| 2009/0159516 | A1 * | 6/2009 | Andrei | E04H 4/1272 210/167.12 |
| 2013/0007954 | A1 * | 1/2013 | Sutton | F16K 31/52483 4/490 |

* cited by examiner

SWIMMING POOL SKIMMERS AND SKIMMER NOZZLE CONNECTORS

CROSS REFERENCE TO RELATED APPLICATIONS

This application is a continuation-in-part application of the earlier U.S. Utility Patent Application to Goettl et al. entitled "Methods and Apparatuses to Relieve Excessive Suction within Swimming Pool Skimmers," application Ser. No. 14/980,759, filed Dec. 28, 2015, now pending, which application is a continuation-in-part application of the earlier U.S. Utility Patent Application to Goettl et al. entitled "Methods and Apparatuses to Relieve Excessive Suction within Swimming Pool Skimmers," application Ser. No. 14/496,201, filed Sep. 25, 2014, which application claims benefit of the priority of provisional patent application Ser. No. 61/882,544, entitled "Methods and Apparatuses to Relieve Excessive Suction within Swimming Pool Skimmers" to Goettl, which was filed on Sep. 25, 2013, the disclosures of each of which are hereby incorporated herein by this reference.

BACKGROUND

1. Technical Field

Aspects of this document relate generally to pool skimmer systems.

2. Background Art

Most swimming pools have a skimming device connected to the suction of a pump to draw water from the pool at or very near the pool surface. These devices usually include a basket or strainer to separate larger debris such as leaves and other floating particles. Water drawn from the skimmer can be connected to the suction of a pump that is connected to a typical swimming pool filter system and returned back to the pool in one or more ordinary ways well known in the art. It is common to connect the suction of several pumps to a skimmer in order to enhance skimming action. There are skimmers, commonly called venturi skimmers, equipped with a pressure jet located to entrain water within the skimmer and eject it back to the pool through a relatively short, unobstructed conduit. This method produces a significant flow increase through the skimmer, resulting in improved surface debris entrapment.

Typically, the pump suction connected to a skimmer is also connected to one or more other drains within the pool. This provides protection to the skimmer basket should it become blocked by debris. The suction is simply diverted to the other drain thereby protecting the skimmer basket from deformation or bursting.

In the case of a venturi skimmer, when the debris basket becomes blocked the venturi return line becomes a point of suction that can be very dangerous to a bather. When the suction of a pump is connected to a Venturi-type skimmer, the flow through the venturi return is reversed when the basket becomes full due to the suction of the separately attached pump.

There are skimming devices that provide air relief in an effort to solve the forgoing problems. U.S. Pat. No. 5,830,350 to Price describes a skimmer basket that has a central perforated pylon extending from the basket bottom to above the basket rim. The pylon consumes a portion of the basket capacity and is difficult to manufacture. U.S. Pat. No. 7,300,576 to Blake describes a conventional Venturi skimmer with an external tube running from the upper interior of the main skimmer body to a location below the skimmer basket in the main skimmer body. This method results in a necessarily small tube on the exterior of the skimmer. This small tube is costly to manufacture and very difficult to clean due to the 90 degree turns associated with the small tube. Furthermore, the chance of damaging the skimmer during the construction process is also increased due to its exterior nature.

SUMMARY

According to one aspect, a pool skimmer may comprise a skimmer housing comprising a pool throat opening, a deck throat opening, a basket opening within the skimmer housing, a skimmer bottom distal the deck throat opening, one or more pump suction ports extending through the skimmer bottom, and a pool return port extending through a sidewall of the skimmer housing, and a venturi system comprising a pump inlet port extending through the skimmer bottom, the pump inlet port comprising an upper end and bayonet lugs extending inward of an internal surface of the pump inlet port, the pump inlet port further comprising an internally threaded surface between the bayonet lugs and the upper end of the pump inlet port, and at least a first nozzle on a nozzle housing comprising bayonets on an external surface of the nozzle housing, the bayonets releasably engaged with the bayonet lugs of the pump inlet port, wherein when the bayonets of the nozzle housing are in a fully tightened position in relation to the bayonet lugs of the pump inlet port, the at least a first nozzle is directed to spray toward the pool return port of the skimmer housing.

Particular embodiments may comprise one or more of the following features. The venturi system may further comprise at least a second nozzle operably coupled to and in fluid communication with the pump inlet port, the at least a second nozzle comprising a nozzle opening smaller than a cross-sectional area of the pump inlet port and positioned to spray fluid received through the pump inlet port into the pool return port, wherein the first nozzle is directed toward a center of the pool return port and the second nozzle is directed toward an off-center portion of the pool return port. The second nozzle may extend at least partially into the pool return port and narrows towards the pump inlet port. A tube coupled to the venturi system, the tube comprising a first end extending to an outer surface of the skimmer housing and a second end in fluid communication with at least one of the first nozzle and the second nozzle. The pump inlet port and the internal threads of the pump inlet port are sized to receive an externally threaded pressure test plug. An externally threaded portion of the pressure test plug may have a height less than a distance between the bayonet lugs and the upper end of the pump inlet port. A lower surface of the pressure test plug seats against at least one of a floor of the skimmer housing and the upper end of the pump inlet port. An angled pool throat extension coupled to the pool throat opening, wherein a plane parallel to an input to the angled pool throat extension and a plane parallel to an output to the angled pool throat extension are not parallel to each other. The plane of the input to the angled pool throat extension and the plane of the output to the angled pool throat extension are approximately 6° different from each other. A weir door pivotally coupled to one of the pool throat opening and the angled pool throat extension. A channel extending from a channel lower end to a channel upper end, the channel positioned between a skimmer rim and an outer wall of the skimmer housing, the channel upper end positioned at an elevation that is least halfway between a lower wall and an upper wall of the pool throat opening. A continuous fluid path extending from the one or more suction ports through the channel to the channel upper end when a basket is on the skimmer rim of the skimmer housing.

According to an aspect, a pool skimmer may comprise a skimmer housing comprising a pool throat opening, a deck throat opening, a basket opening within the skimmer housing, a skimmer rim proximate the basket opening, a skimmer bottom distal the deck throat opening, one or more pump suction ports distal the deck throat opening, and a pool return port extending through a sidewall of the skimmer housing, a venturi system comprising a pump inlet port extending through the skimmer bottom, and at least a first nozzle on a nozzle housing engaged with the bayonet lugs of the pump inlet port, wherein the at least a first nozzle is directed to spray toward the pool return port of the skimmer housing, and an angled pool throat extension comprising an input comprising an input plane parallel to the input and an output comprising an output plane parallel to the output, the angled pool throat extension coupled to the pool throat opening, wherein the input plane is not parallel to the output plane.

Particular embodiments may comprise one or more of the following features. The input plane and the output plane are approximately 6° different from each other. The pump inlet port comprising an upper end and bayonet lugs extending inward of an internal surface of the pump inlet port, the pump inlet port further comprising an internally threaded surface between the bayonet lugs and the upper end of the pump inlet port; and the nozzle housing comprising bayonets on an external surface of the nozzle housing, the bayonets releasably engaged with the bayonet lugs of the pump inlet port, wherein when the bayonets of the nozzle housing are in a fully tightened position in relation to the bayonet lugs of the pump inlet port, the at least a first nozzle is directed to spray toward the pool return port of the skimmer housing. The pump inlet port and the internal threads of the pump inlet port are sized to receive an externally threaded pressure test plug. An externally threaded portion of the pressure test plug has a height less than a distance between the bayonet lugs and the upper end of the pump inlet port. A lower surface of the pressure test plug seats against at least one of a floor of the skimmer housing and the upper end of the pump inlet port. The venturi system further comprises at least a second nozzle operably coupled to and in fluid communication with the pump inlet port, the at least a second nozzle comprising a nozzle opening smaller than a cross-sectional area of the pump inlet port and positioned to spray fluid received through the pump inlet port into the pool return port. The second nozzle extends at least partially into the pool return port and narrows from the pool return port towards the pump inlet port, and wherein the first nozzle is directed to a center of the pool return port and the second nozzle is directed toward an off-center portion of the pool return port; the pool skimmer further comprising a tube coupled to the venturi system, the tube comprising a first end extending to an outer surface of the skimmer housing and a second end in fluid communication with at least one of the first nozzle and the second nozzle.

According to an aspect of the disclosure, a pool skimmer may comprise a skimmer housing comprising a pool throat opening, a deck throat opening, a basket opening within the skimmer housing, a skimmer rim proximate the basket opening, a skimmer bottom distal the deck throat opening, one or more pump suction ports, and a pool return port, and an angled pool throat extension comprising an input comprising an input plane parallel to the input and an output comprising an output plane parallel to the output, the angled pool throat extension coupled to the pool throat opening, wherein the input plane is not parallel to the output plane.

In particular embodiments, the pool throat opening may comprise a center plane extending vertically through a center of the pool throat opening from a center of the skimmer housing, the pool skimmer further comprising a pool return extending from the pool skimmer housing to a position on a swimming pool wall horizontally offset from the center plane.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended pool skimmer systems and/or assembly procedures for pool skimmer systems will become apparent for use with implementations of pool skimmer systems from this disclosure. Accordingly, for example, although particular pool skimmer systems are disclosed, such pool skimmer systems and implementing components may comprise any shape, size, style, type, model, version, measurement, concentration, material, quantity, and/or the like as is known in the art for such pool skimmer systems and implementing components, consistent with the intended operation of pool skimmer systems.

Figure 1:
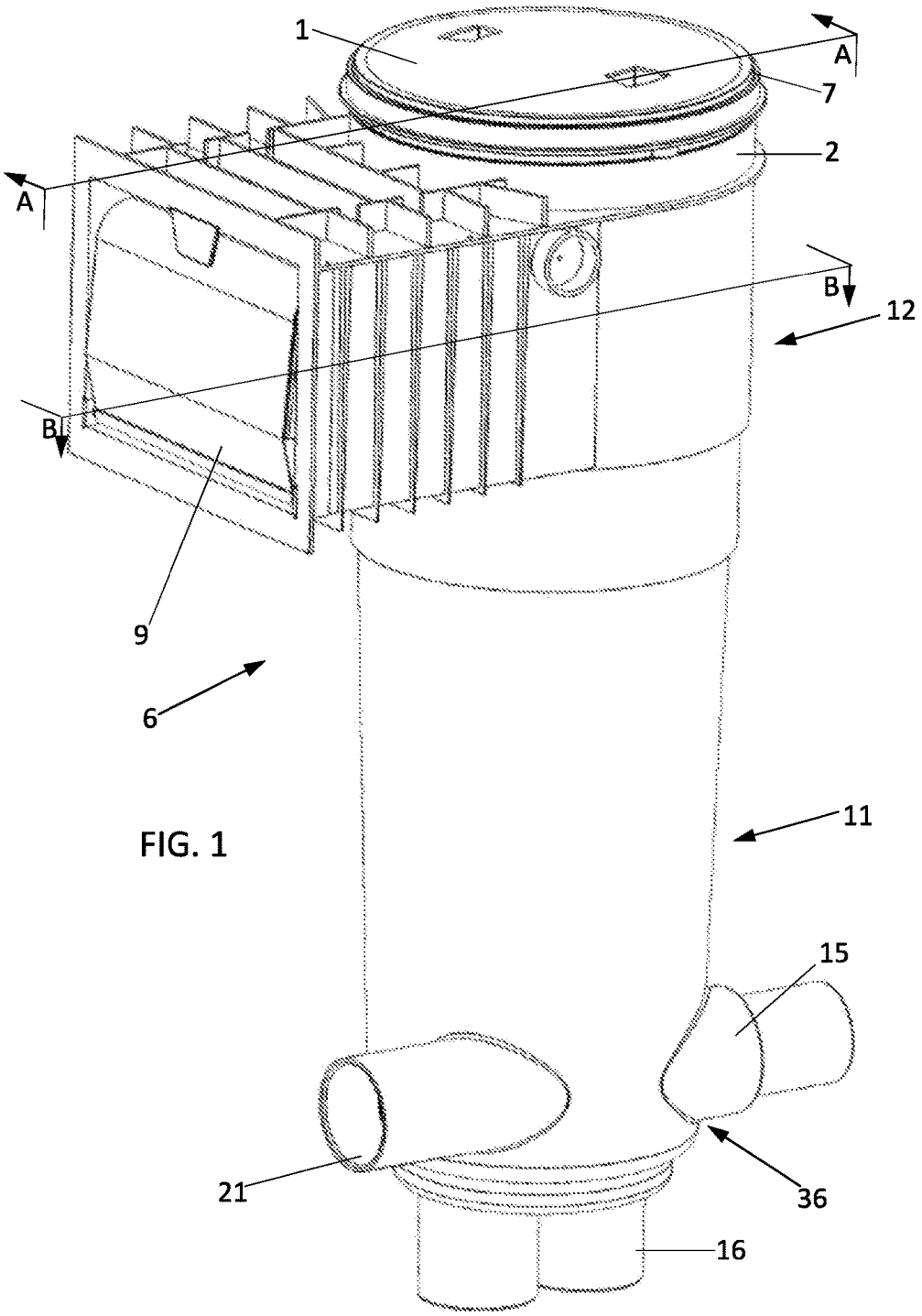
FIG. 1 is a perspective view of a pool skimmer system.

FIG. 1 depicts a non-limiting embodiment of a pool skimmer housing of a pool skimmer system 6. Reference is made throughout this document to an upper skimmer housing 12 and a lower skimmer housing 11. It is contemplated that the upper skimmer housing 12 and the lower skimmer housing 11 may comprise two separate and individual pieces coupled together, or a single piece integrally formed during manufacture. In the non-limiting embodiment depicted in FIG. 1, the upper skimmer housing 12 and the lower skimmer housing 11 comprise two separate pieces coupled together. It is further contemplated embodiments of a pool skimmer system 6 in general and a pool skimmer housing referenced in this document may comprise various features of a pool skimmer housing previously known in the art, such as but not limited to a pool throat opening 3 having an upper wall 17 and a lower wall 18 (shown in FIG. 2), a weir 9 hingedly or otherwise pivotally coupled to the upper skimmer housing 12 proximate a pool throat opening 3, a deck closure or cover 1 coupled to the upper skimmer housing 12 proximate a deck throat opening 5, one or more pump suction ports 16 on a bottom 20 of the lower skimmer housing 11, a finish edge 7, a skimmer interior wall 4, a deck ring 2, and the like. In one or more embodiments, the pool surface elevation is approximately one-half of the pool throat opening 3, or halfway between the upper wall 17 and the lower wall 18 of the pool throat opening 3. However, the pool elevation can vary from upper elevation at the upper wall 17 to a lower elevation at the lower wall 18 due to increased bather influx, rain, insufficient make up water, and other reasons known in the art. Some skimmer embodiments are adapted with an overflow port to limit and provide an attachment point of piping to carry away overflow to a suitable area away from the pool. Normally, the maximum water containing height of a pool is approximately upper elevation at the upper wall 17.

The skimmer housing typically further comprises a basket opening positioned within the pool skimmer housing and sized to house a basket 10. To facilitate housing of the basket 10 within the skimmer housing, the upper skimmer housing 12 comprises a first basket opening 61 and the lower skimmer housing 11 comprises a second basket opening 62 aligned with the first basket opening 61.

Figure 2:
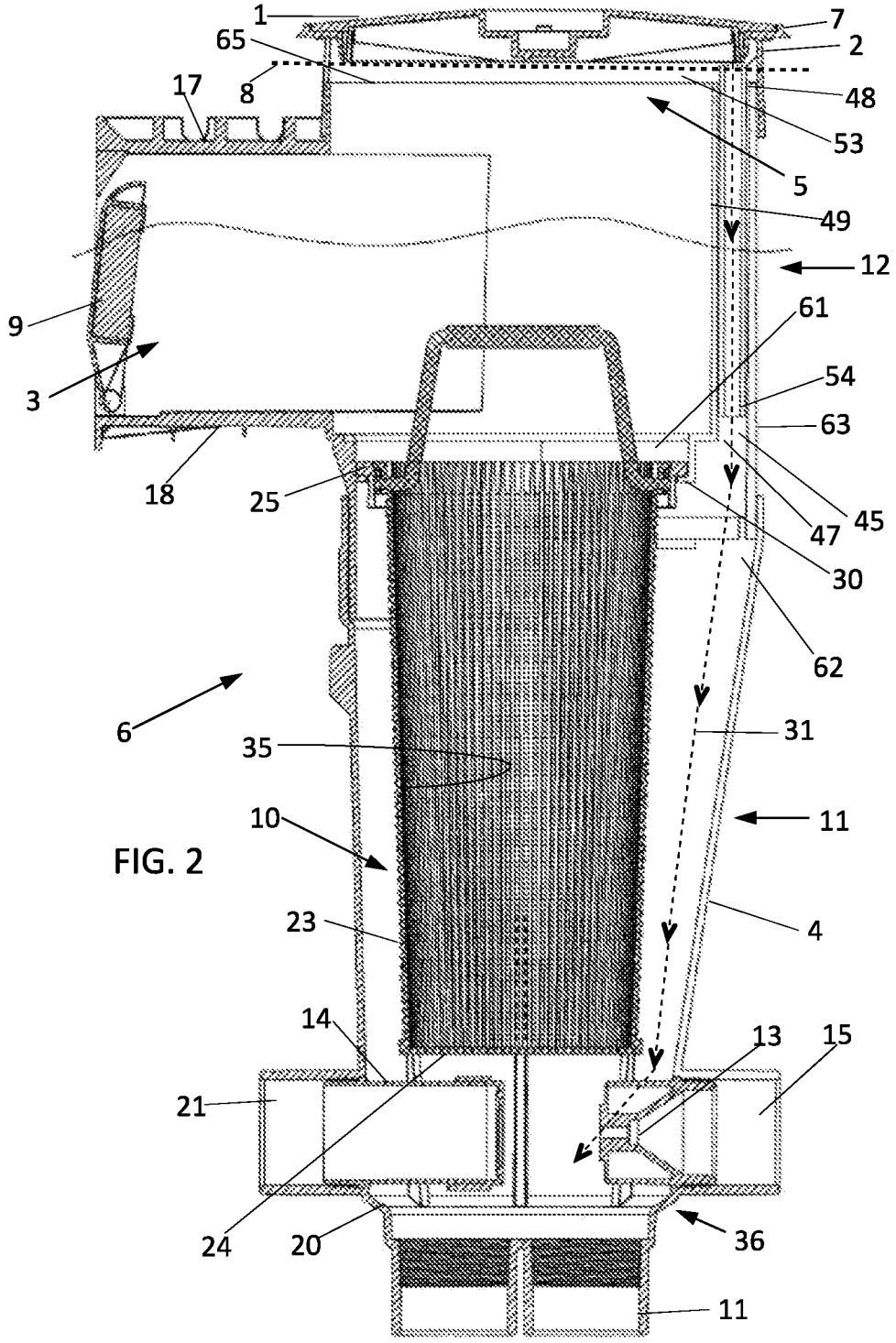
FIG. 2 is a cross sectional view of a pool skimmer system taken along sectional line A-A of FIG. 1.

Additionally, the lower skimmer housing 11 may comprise a venturi system 36 (shown in FIG. 2). The venturi system typically comprises a pump inlet port 15 having a venturi nozzle 13 coupled thereto and a pool return port 21 having a venturi sleeve 14 coupled thereto. The venturi system 36 may operate as is known to those having ordinary skill in the art. For example, a pool pump associated with the system may pull water in the skimmer housing into the one or more pump suction ports 16 or any other suction ports known in the art, push water into the skimmer housing through the pump inlet port 15, and push water into the pool return port 21 to return filtered water back into the pool and create a high velocity flow to entrain water in the skimmer housing, thereby creating an increased flow through the skimmer. The one or more conventional pump suction ports 16 are configured for connection of additional pump or pump suction and drain connection in the conventional manner.

In one or more embodiments, the upper skimmer housing 12 comprises a skimmer rim 30 proximate the first basket opening 61. FIG. 2 depicts a cross sectional view taken along line A-A in FIG. 1 of a non-limiting embodiment of a skimmer system that includes a skimmer rim 30. According to some aspects, the skimmer rim 30 is a continuous rim that forms a boundary of the first basket opening 61. The skimmer rim 30 is configured to engage with a portion of the basket 10, typically the basket rim 25 to hold the basket in an operable position within the skimmer housing. The skimmer rim 30 is, therefore, typically shaped complementary to the shape of skimmer basket 10. In some embodiments, the skimmer rim 30 is substantially level with the lower wall 18 of the skimmer throat opening 3, while in other embodiments, such as the non-limiting embodiment depicted in FIG. 2, the skimmer rim 30 is positioned below the lower wall 18 of the skimmer throat opening 3.

One or more embodiments of a skimmer system 6 further comprise a channel 45 formed between an outer wall 63 of the upper skimmer housing 12 and a channel inner wall 49 of the upper skimmer housing 12. The channel 45 extends from a lower end 47 to an upper end 48. The lower end 47 is typically positioned between the skimmer rim 30 and the outer wall 63 of the upper skimmer housing 12. Thus, the lower end 47 may be positioned at an elevation that is substantially level with or lower than the lower wall 18 of the pool throat opening 3. In some embodiments, such as the non-limiting embodiment depicted in FIG. 2, the channel 45 narrows between the level of the skimmer rim 30 and the level of the lower wall 18 of the pool throat opening 3.

The upper end 48 of the channel 45 is typically positioned at an elevation 8 that is at least halfway between the lower wall 18 and upper wall 17 of the pool throat opening 3. In more particularly embodiments, the channel 45 extends to an upper end 48 that is at an elevation that is at least level with the upper wall 17 of the pool throat opening 3. In still more particular embodiments, such as the non-limiting embodiment depicted in FIG. 2, the channel 45 extends to an upper end 48 that is at an elevation that is above the level of the upper wall 17. In such embodiments, the channel 45 extends to the top end 65 of the deck throat opening 5 of the upper skimmer housing 12. At the top end 65 of the deck throat opening 5, an end chamber 53 is formed by the deck ring 2, the finish edge, and the deck closure 1 and the deck throat opening 5. Because the end chamber is positioned above the upper wall 17 of the pool throat opening 3, the end chamber 53 will always have air held therein.

Figure 3:
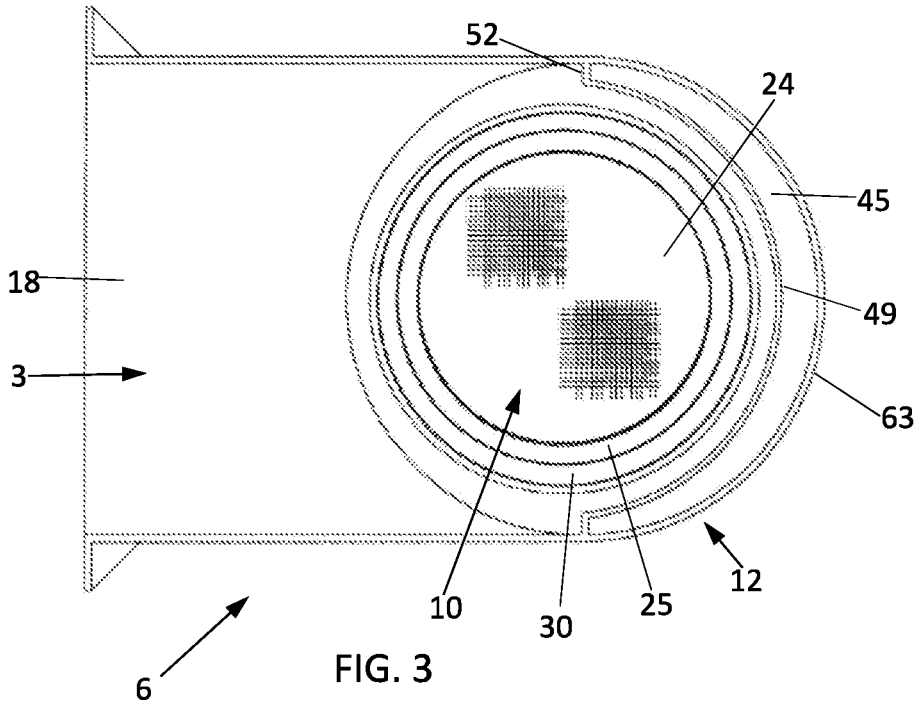
FIG. 3 is a cross sectional view of a pool skimmer system with a first embodiment of a channel taken along sectional line B-B of FIG. 1.

Various embodiments of pool skimmer systems may comprise channels of different sizes and configurations. For example, in the not limiting embodiment depicted in FIGS. 2 and 3, the channel 45 arcs approximately 180 degrees between two channel end walls 52. In other embodiments, such as the non-limiting embodiment of a pool skimmer system 70 depicts in FIG. 4, the channel 75 arcs approximately 90 degrees between two channel end walls 72. Like other embodiments, the channel 75 is formed between an inner wall 71 and an outer wall 63 of an upper skimmer housing 12 and includes an upper end and lower end as described in relation to the channel 45. In such an embodiment, the slidable riser 74 is sized to slidably position within the channel 75. In still other embodiments, a channel may arc greater than 180 degrees, between 135 and 180 degrees, between 90 and 135 degrees, between 45 and 90 degrees, or less than 45 degrees. According to some aspects, the size of the air chamber 45 is significant because if the air chamber 45 is too small for the application, the safety suction release may be insufficient to prevent suction entrapment. If the size of the air chamber 45 is too large, the manufacturing costs may be unnecessarily increased.

In some non-limiting embodiments, the outer wall 63 of the channel is flush with the upper skimmer housing 12 and the channel inner wall 49 is positioned within the upper skimmer housing 12. This results in a smooth exterior shape, which may be preferable for imbedding in concrete as is commonly done. Alternately, the channel 45 may be positioned as an exterior offset rather than an interior offset. In such embodiments, the channel inner wall 49 may be flush with the upper skimmer housing 12 and the outer wall 63 may protrude outwardly from the upper skimmer housing 12.

According to some aspects, a pool skimmer system 6 further comprises a slidable riser 54. The slidable riser 54 is shaped complementary to the channel 45 and configured to slidably mounted within the channel 45. The slidable riser 54 typically comprises a passage extending through the riser 54 and allows a user to extend the fluid path 31 beyond the top end 65 of the upper skimmer housing 12. For example, when the riser 54 extends above the top end 65 of the upper skimmer housing 12, the fluid path 31 extends from the one or more suction ports to the channel 45, from the channel to the passage of the riser 54, and from the passage of the riser 54 to the end chamber 53 or the open air above the top end 65 of the upper skimmer housing 12.

Figure 4:
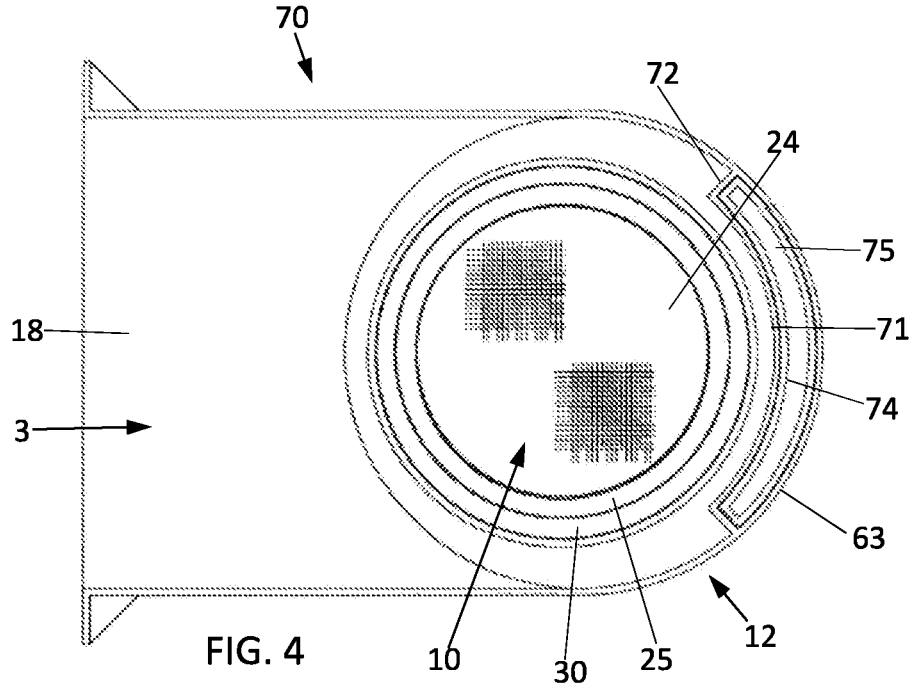
FIG. 4 is a cross sectional view of a pool skimmer system with a second embodiment of a channel taken along sectional line B-B of FIG. 1.
Figure 5:
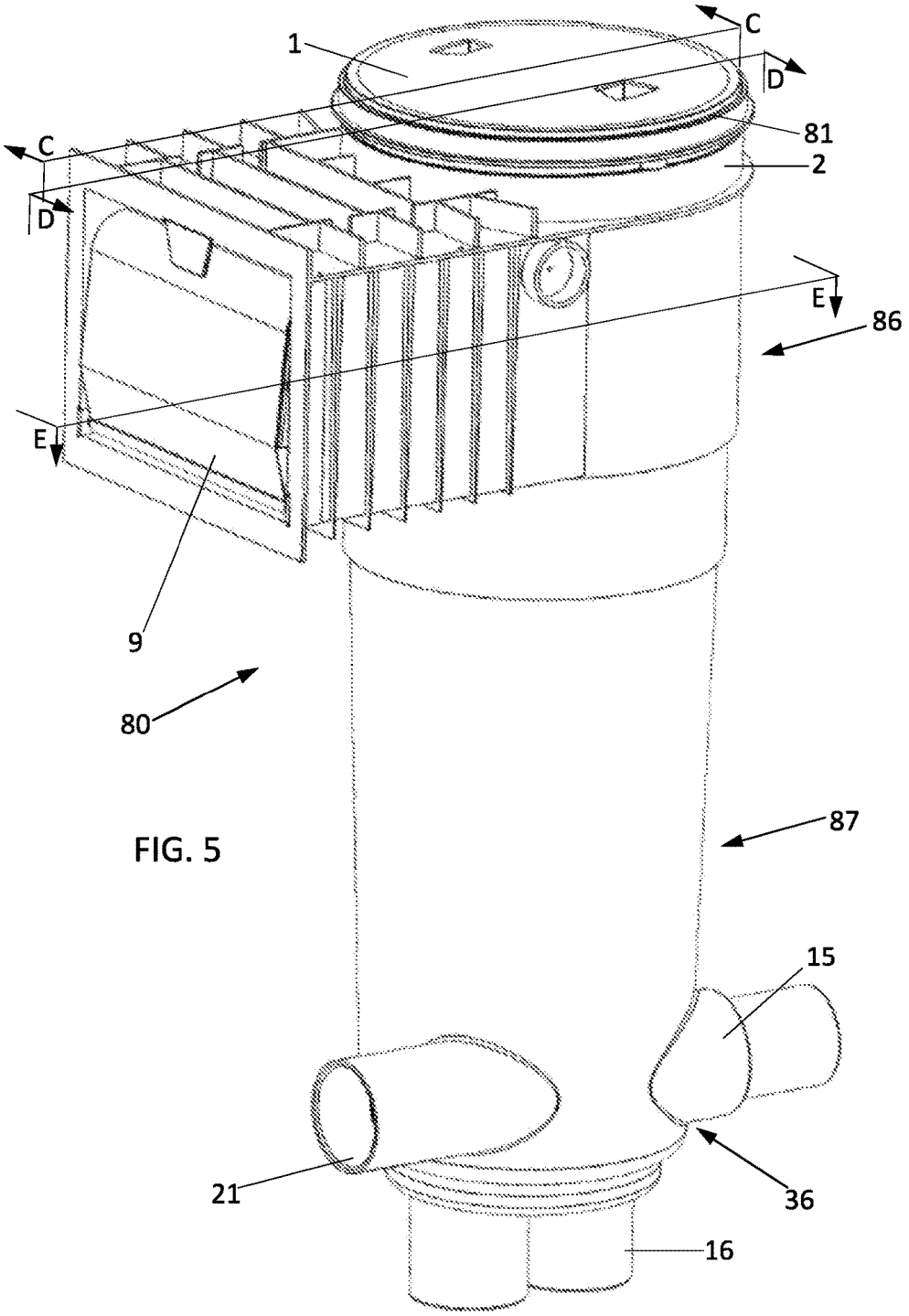
FIG. 5 is a perspective view of a second embodiment of a pool skimmer system.

As a slidable riser 54 is configured to slidably mount within the channel 45 in a substantially air tight fit, the slidable riser 54 is typically shaped complementary to the channel 45. For example, in the non-limiting embodiment depicted in FIGS. 2 and 3, the riser comprises an arc that is substantially equal or just less than the approximate 180 degree arc of the channel 45. In FIG. 4, the slidable riser 74 comprises an arc that is substantially equal to or just less than the approximate 90 degree arc of the channel 75. In other embodiments, the slidable riser comprises an arc that is substantially equal to or just less than the arc of the channel. It should be noted that some leakage of water into air chamber can be tolerated with no effect to entrapment protection as the forming ring 2 is moved up or down as is commonly done to adjust forming ring 2 to the correct deck elevation during the construction process. Atmospheric or fluid communication the channel 45 is maintained at the highest possible point providing maximum entrapment protection.

Various embodiments of a pool skimmer system 6 further comprise a basket 10. The basket 10 typically comprises an basket opening 32 at a top end of the basket 10, a porous basket bottom 24, one or more porous walls 23 extending between the top end and porous basket bottom 24, and an inner basket surface 35 within the basket 10. One or more embodiments of a basket 10 may further comprise a handle. The basket 10 is sized such that a fluid path 31 is formed between the one or more porous walls 23 and the skimmer interior walls 4 of the lower skimmer housing 11. The fluid path 31 typically comprises an open space of at least 0.5 inches from the skimmer interior wall 4 of the lower skimmer housing 11 to the porous wall 23 of the basket 10. In other embodiments, the fluid path 31 may comprise an open space of approximately 0.25 inches, 0.5 approximately inches, approximately 0.75 inches, or greater than approximately 1.0 inches from the skimmer interior wall 4 of the lower skimmer housing 11 to the porous wall 23 of the basket 10. According to some aspects, the basket 10 further comprises a basket rim 25, typically proximate the open top end of the basket 10. The basket rim 25 is configured to engage with the skimmer rim 30 and hold the basket 10 in an operable position within the skimmer housing. The pool throat opening 3 is positioned to intersect a portion of the upper end of the basket 10 when the basket is operably mounted within the housing in one or more embodiments. The width of the pool throat opening 3 and diameter of the basket 10 are substantially equal in some embodiments. In other embodiments, however, the width of the pool throat opening 3 and the diameter of the basket 10 may differ. In this way, debris will flow into the basket 10 when the pool level is within a range from the upper pool wall 17 and the lower pool wall 18.

One or more embodiments of a pool skimmer system 6 further comprise a fluid path 31 that extends between the channel 45 and the one or more pump suction ports 16. The fluid path 31 allows uninterrupted fluid communication from at least one of the pump suction ports 16 and the pool return port 21 to the upper end 48 of the channel 45 and/or the end chamber 53 even when a basket 10 is mounted in the skimmer housing. In operation, water flow may enter the pool throat opening 3 over weir 9 and continue into the basket 10, and then flow to the suction ports 16. As described above, a channel 45 may be positioned in the upper skimmer housing 12, the channel 45 allowing atmospheric or fluid communication from an upper end 48 of the channel 45 with the interior flow path 31. The channel 45 may be positioned such that atmospheric or fluid communication is allowed even when the pool level is at the upper wall 17. A normal water level, however, is usually maintained approximately mid-way between the upper wall 17 and the lower wall 18. In this way, dangerous over-suction is prevented by allowing atmosphere or air to enter the lower skimmer housing 11 through the channel 45.

It will be understood by those skilled in the art that leaves and other debris being drawn into a pool throat opening 3 are trapped in the basket 10 and generally drawn to an inner basket surface 35. Debris may continue to collect at the inner basket surface 35 until substantially all of the inner basket surface 35 is covered. Covering all of the inner basket surface 35 disrupts the flow of water into the pump suction ports 16 and may create a vacuum in the skimmer housing by conventional pump suction port(s) 16 and/or the venturi system 36. The vacuum may be great enough to deform baskets of the prior art. In the case of the pump suction being connected to conventional pump suction port(s) 16 and venturi system 36, the flow is reversed by the pump suction and causes a dangerous suction condition at pool return port 21.

In one or more of the skimmer systems described herein, the above described over-suction condition cannot occur because air is allowed to enter the upper end 48 of the channel 45 above the pool level. The highest possible vacuum in the fluid path 31 is limited to water depth between the pool return port 21 and the water level of the pool. This water depth usually does not exceed 24 inches. As the pump suction ports 16 and/or or Venturi system 36 draw water from the skimmer housing, air will be drawn into the pump suction ports 16 and/or Venturi system 36 through the channel 45 with an upper end 48 above the pool level, thereby causing suction pump (not shown) to draw in air and cease operation. When pump suction at the pump suction port 16 ceases, any reversing of the Venturi system 36 and the resultant dangerous suction at pool return port 21 will cease, or be limited, to the water depth between the pool return port 21 and the pool water level. A basket opening 32 (shown in FIG. 2) may be below the lower wall 18 of the pool throat opening 3 to maximize the skimmer operating range. The lower end 47 of the channel 45 is above basket bottom 24 and preferably above basket upper rim 25. More particularly, in some embodiments the lower end 47 of the channel 45 is positioned above an elevation of the upper basket rim 25 when the basket 10 is operably positioned within the skimmer housing.

It is evident that current invention overcomes the disadvantages by eliminating external tubing and easier maintenance. It is also apparent that if the basket is not installed the skimmer would employ the same safety features as described. In particular embodiments, the upper skimmer housing 12 and the lower skimmer housing 11 may be adapted to fit only basket of current disclosures to prevent unapproved baskets from being used. In other embodiments, any skimmer basket previously known in the art may be used. The basket rim 25 may also be adapted to form a handle for improved ease of removal of basket 10 for periodic cleaning without submerging hands in water as with prior art devices.

FIGS. 5-9 depict another non-limiting embodiment of a pool skimmer system 80. Unless otherwise specified, aspects and elements of a pool skimmer system 80 are similar to those described elsewhere in this document, such as but not limited to an upper skimmer housing 86, a lower skimmer housing 87, a weir 9, a cover 1, a pool throat opening 3 having an upper wall 17 and a lower wall 18, a basket 10, one or more pump suction ports 16, a pool return port 21, a venturi sleeve 14, a venturi nozzle 13, a pump inlet port 15, a deck throat opening 5, a first basket opening 91, a second basket opening 92, a skimmer interior wall 96 and/or a skimmer bottom 20.

Like other embodiments described herein, a pool skimmer system 80 may comprise a fluid path 88 that extends from the one or more pump suction ports 16 to an end chamber 94 at least halfway between the lower wall 18 and the upper wall 17. Typically, the end chamber 94 is above the upper wall 17 of the deck throat opening 3, as depicted in the non-limiting cross sectional view of FIG. 6. The fluid path 88 comprises all the advantages described in relation to the fluid path 31 of other embodiments. The lower skimmer housing 87 is typically configured such that the fluid path 88 extends between the sidewall 23 of the basket 10 and the interior skimmer wall 96 of the lower skimmer housing 87. Accordingly, the skimmer rim 89 on the upper skimmer housing 86 is positioned to hold the basket 10 such that a space exists between the porous walls 23 and the skimmer interior wall 96 to allow a fluid path 88 to be formed between the one or more pump suction ports 16 and the channel 83. FIG. 7 depicts a cross sectional view of the a pool skimmer system 80 with the basket 10 removed to allow an unobstructed view of the skimmer rim 89 and the first basket opening 91.

Figure 6:
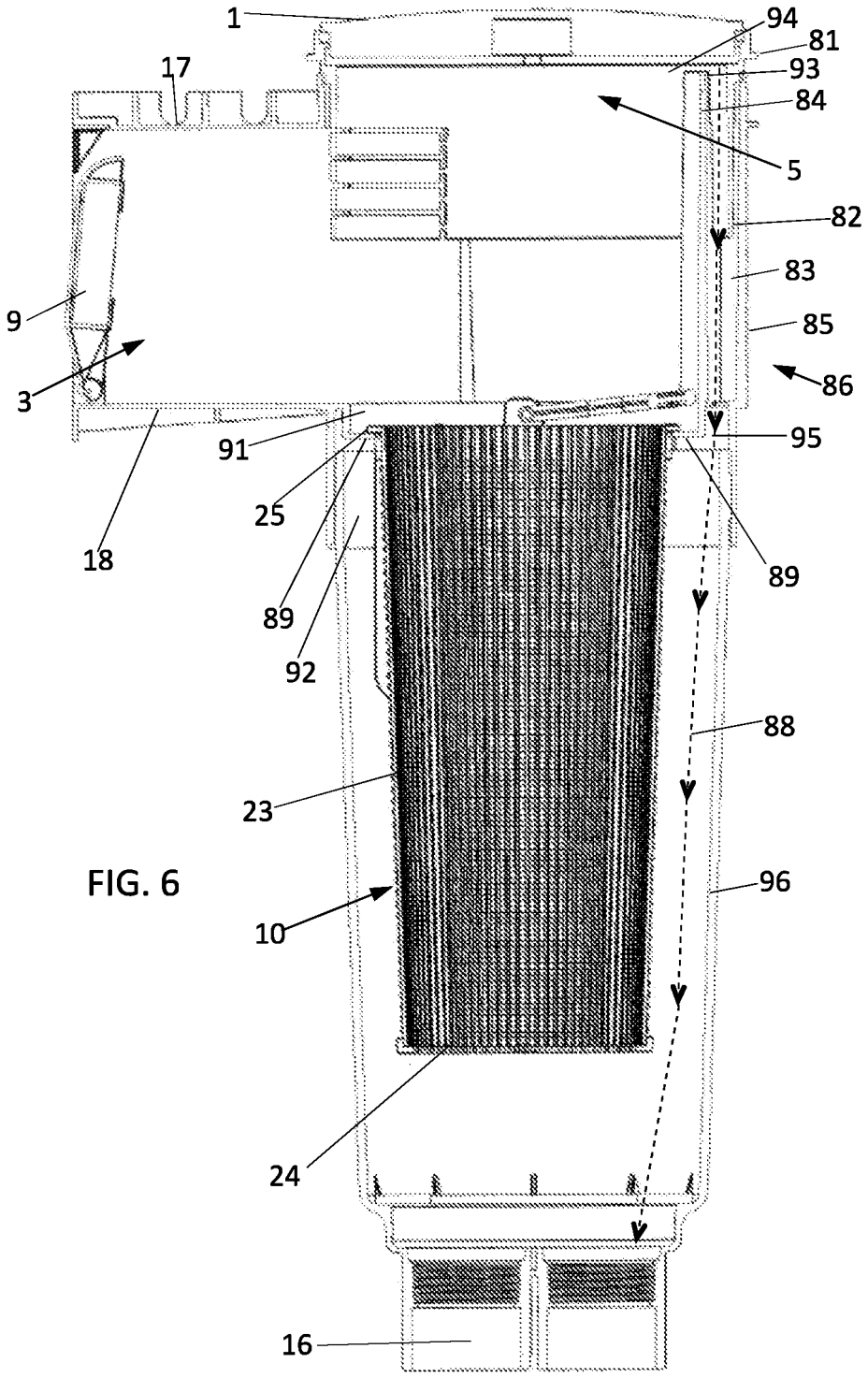
FIG. 6 is a cross sectional view of a second embodiment of a pool skimmer system taken along line C-C of FIG. 5.
Figure 7:
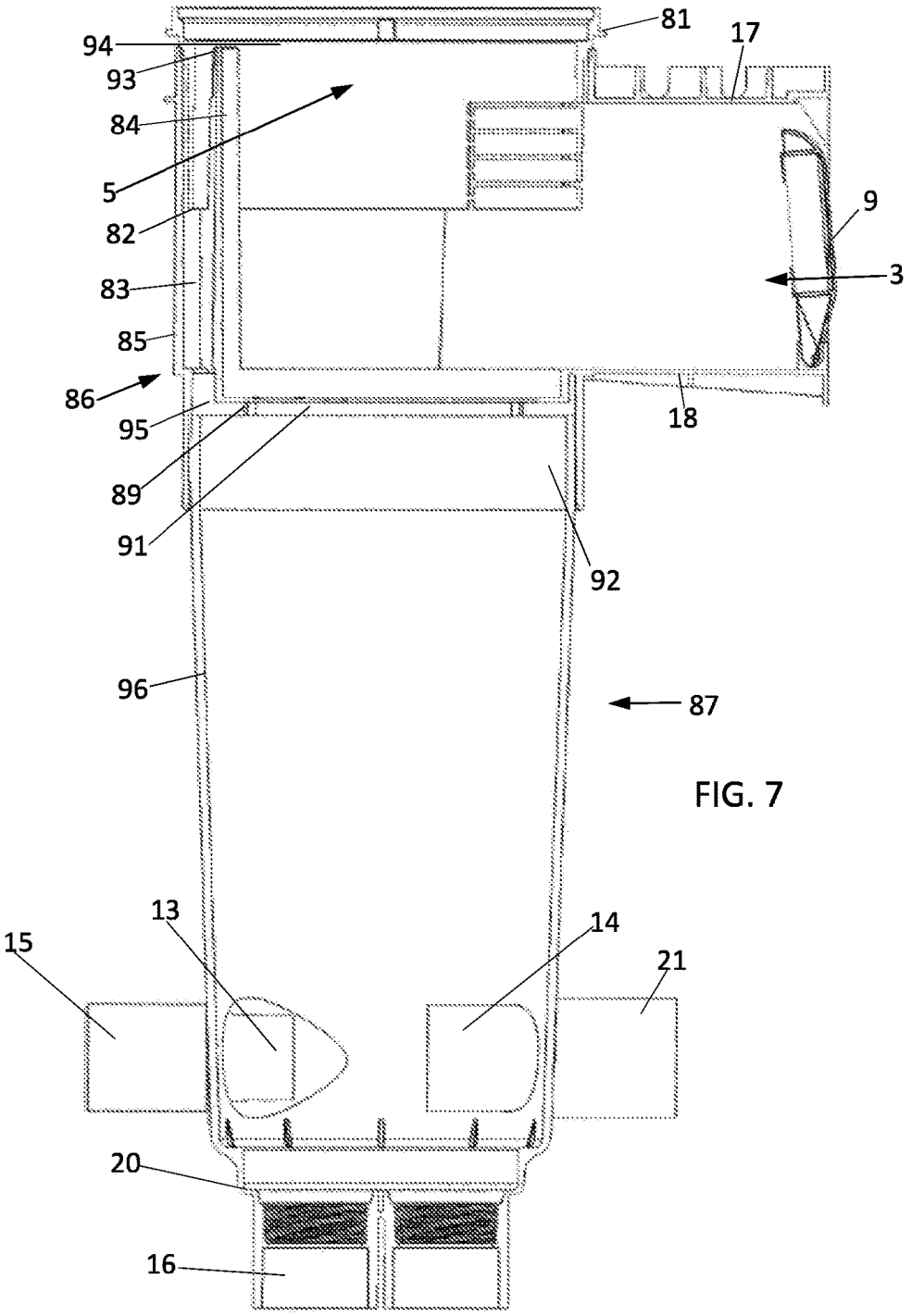
FIG. 7 is a cross sectional view of a second embodiment of a pool skimmer system taken along line D-D of FIG. 5 with the basket removed.
Figure 8:
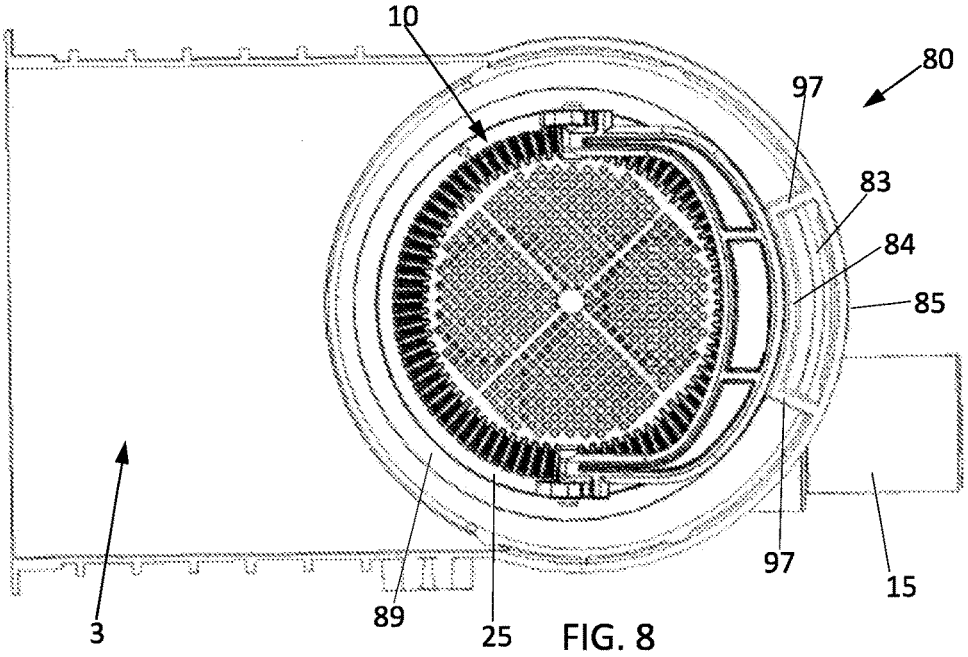
FIG. 8 is a cross sectional view of a second embodiment of a pool skimmer system taken along line E-E of FIG. 5.

Cross sectionals view presented in FIGS. 6 and 7 further depict another embodiment of a channel 83 that is configured to allow fluid communication between the an end chamber 94 and the fluid path 88 adjacent the basket 10. In one or more embodiments, a channel 83 is formed between a channel inner wall 84 and an outer wall 85 of the upper skimmer housing 86. The channel 83 typically extends from a lower end 95 that is level with or below the lower wall 18 of the pool throat opening 3 to an upper end 93 that is at least halfway between the lower wall 18 and the upper wall 17 of the pool throat opening. More particularly, the upper end 93 of the channel is positioned level with or higher than the upper wall 17 of the pool throat opening, such as the non-limiting embodiment depicted in FIGS. 6 and 7. The channel 83 is bordered on opposing sides by end walls 97 (shown in FIGS. 8 and 9). As described in other embodiments, the end walls 97 may be placed at varying degrees from one another. In the non-limiting embodiment depicted in FIGS. 8 and 9, the end walls 97 are positioned less than 90 degrees from one another. More particularly, the end walls are positioned between 30 and 60 degrees from one another. In operation, the channel 83 may function similar to other channels 45 described herein. For example, the channel 83 typically provides fluid communication between the end chamber 94 and the fluid path 88 between the basket 10 and the skimmer interior wall 96.

Figure 9:
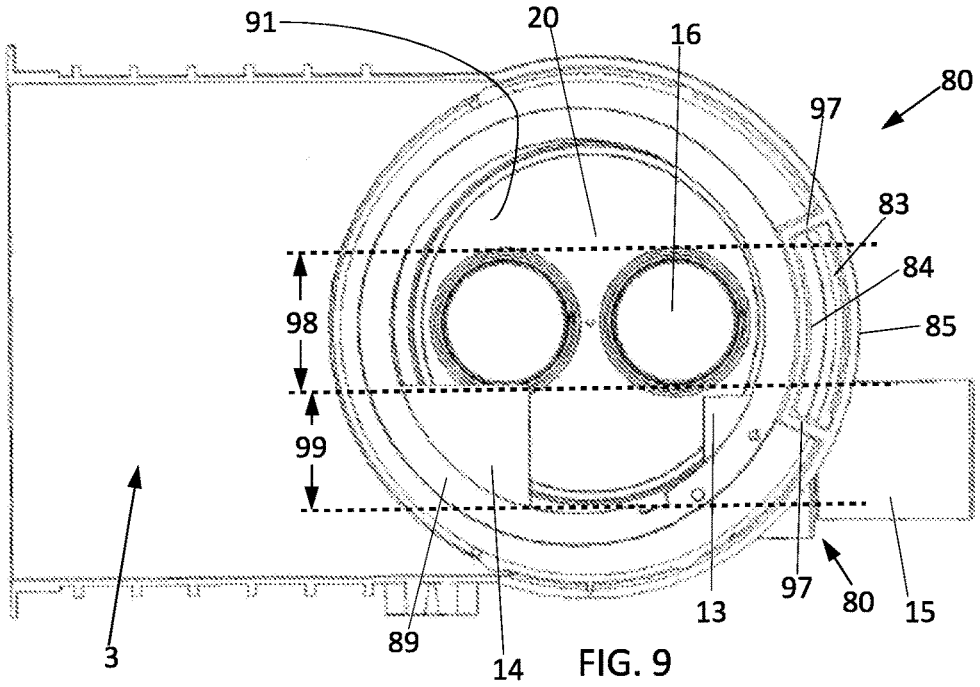
FIG. 9 is a cross sectional view of a second embodiment of a pool skimmer system taken along line E-E of FIG. 5 with the basket removed.

In one or more embodiments, the one or more pump suction ports 16 proximate on the bottom 20 of the lower skimmer housing 87 may be offset from the venturi system 36 proximate the bottom 20 of the lower skimmer housing 87 when viewed from above the pool skimmer system 80. FIG. 9 depicts a top view of a non-limiting embodiment with the basket 10 removed to provide a clear view of the offset configuration of the one or more pump suction ports 16 and the venturi system 36. More particularly, the pump suction ports 16 may be positioned within approximately a middle portion 98 of the skimmer bottom 20 while the venturi system 36 may be positioned on the sidewall of the lower skimmer housing such that the venturi system 36 is positioned over a side portion 99 of the skimmer bottom 20 relative to the middle portion of the skimmer bottom 20. Such a configuration is advantageous because it allows free access to the suction port 16 when the basket 10 is removed from the pool skimmer system 80. This access allows a user to couple a pool accessory to the pump suction port 16, such as but not limited to a vacuum hose.

According to some aspects, a pool skimmer system 80 further comprises a deck ring 81 having an arm 82 positioned to slide within the channel 83 when the deck ring 81 is coupled to the upper skimmer housing 86. The deck ring 81 is further configured to provide a break-away feature.

FIGS. 10-14C depict various views of another non-limiting embodiment of a pool skimmer system 106. Unless otherwise specified, elements of a pool skimmer system 106 may comprise any of the corresponding elements of other pool skimmer systems described herein and their variations, such as but not limited to a deck closure 101, a finish edge 107, a deck throat opening 105, a channel inner wall 149, an upper skimmer housing 112, a first basket opening 161, an outer wall 163, a channel 145, an upper end 148 of the channel 145, a lower end 147 of the channel 145, an arm 182, a skimmer rim 130, a fluid path 131, a lower skimmer housing 111, a skimmer interior wall 104, a basket 110, a porous wall 123 on the basket 110, a porous basket bottom 124 on the basket, an inner basket surface 135, a basket rim 125, a lower wall 118 of the pool throat, an upper wall 117 of the pool throat, a top end 165 of the skimmer housing, and an elevation 108.

Figure 14A:
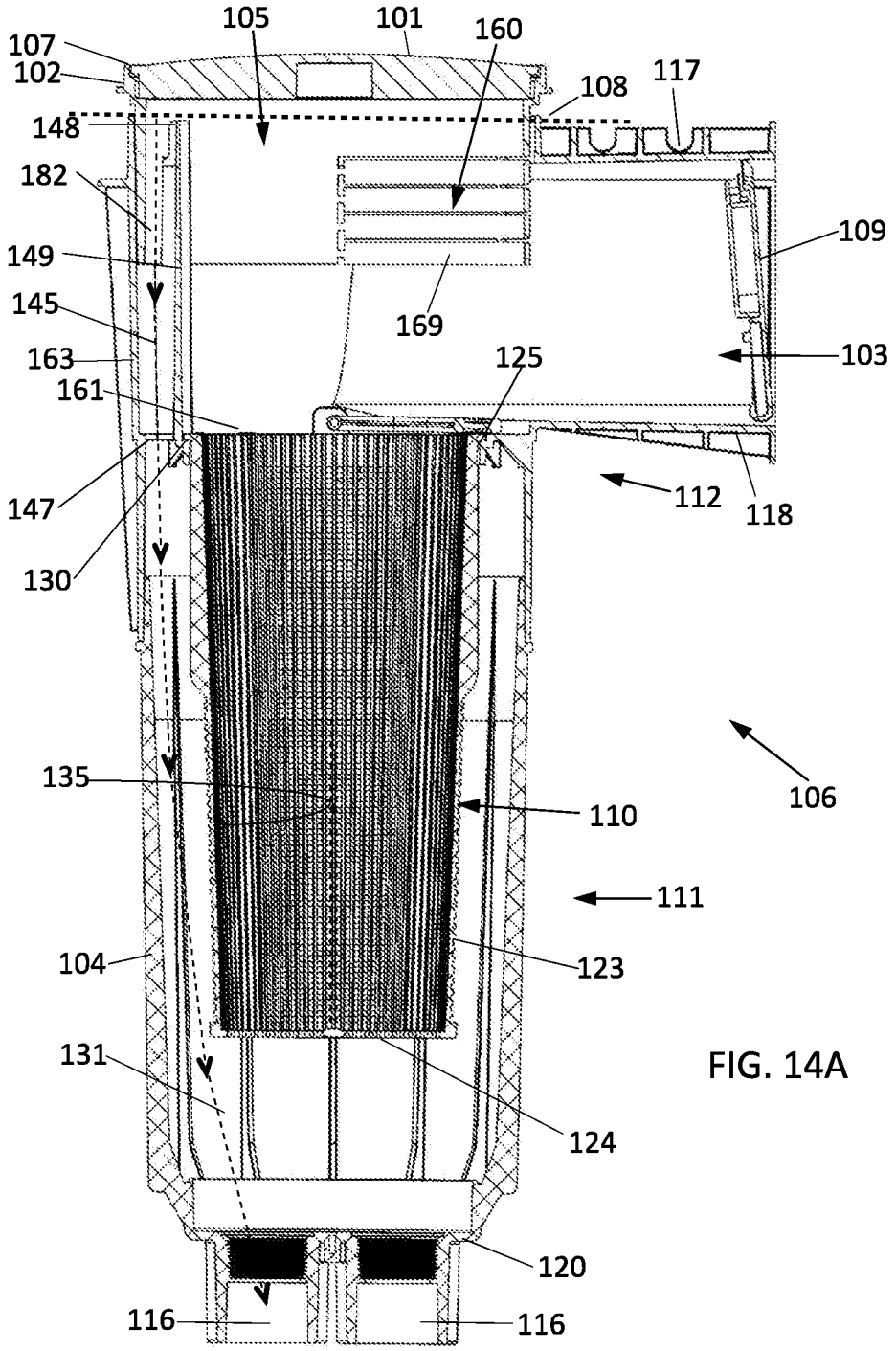
FIG. 14A is a cross sectional view of a third embodiment of a pool skimmer system taken along line G-G of FIG. 12.
Figure 14B:
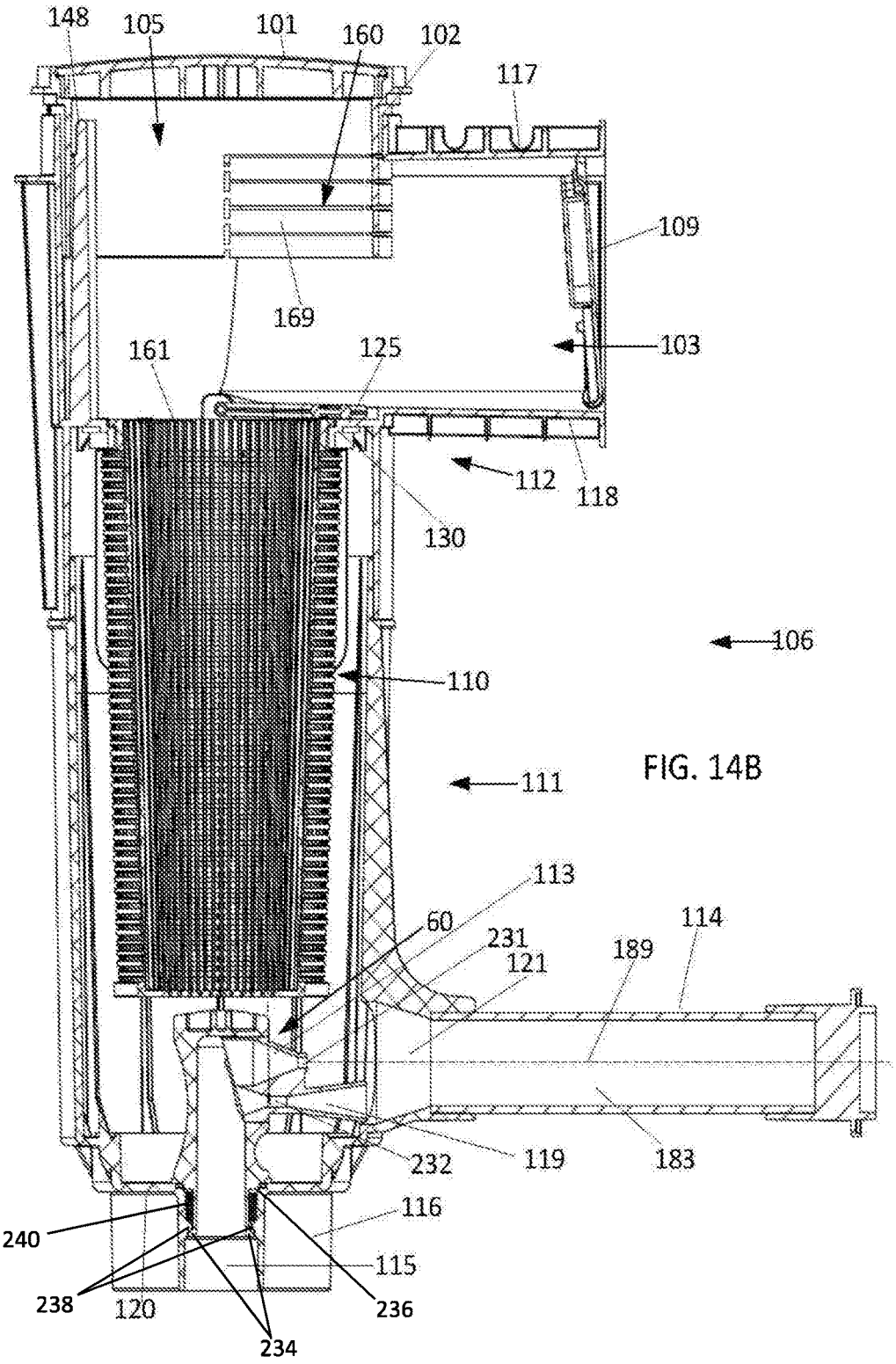
FIG. 14B is a cross sectional view of a third embodiment of a pool skimmer system taken along line F-F of FIG. 12.

One or more embodiments of a pool skimmer system 106 comprise a venturi system 60 comprising a pump inlet port 115, a first nozzle 113 in fluid communication with the pump inlet port 115, and at least a second nozzle 119 in fluid communication with the pump inlet port 115. FIG. 14B depicts a cross-sectional view of a pool skimmer system 106 along line F-F of FIG. 12. In this embodiment, a first nozzle 113 is positioned above a second nozzle 119 of a venturi system 60. More particularly, in some embodiments, the first nozzle 113 is directed toward a center 189 of a pool return port 121 such that the first nozzle 113 is positioned to spray fluid received through the pump inlet port 115 into the pool return port, while a second nozzle 119 is directed toward a lower portion 183 of the pool return port such that the second nozzle 119 is positioned to spray fluid received through the pump inlet port 115 (and/or the tube 211) into the pool return port 121. In other embodiments, the second nozzle 119 may be directed toward the center of the pool return port 121 as well. A dual nozzle venturi system 60 increases the effectiveness of the venturi skimmer pull and eliminates the need for an extra return elsewhere in the pool.

According to some aspects, a first nozzle 113 is operably coupled to and in fluid communication with the pump inlet port 115, through the bayonets 234 of a bayonet connector on the lower outer surface of the venturi system 60 housing engaging with bayonet lugs 238 on the inner surface of the pump inlet port 115, and comprises a nozzle opening 231 smaller than a cross-sectional area of the pump inlet port. A second nozzle 119 is operably coupled to and in fluid communication with the pump inlet port 115 and comprises a nozzle opening 232 smaller than a cross-sectional area of the pump inlet port 115. In some embodiments, the first nozzle 113 narrows from the pump inlet port 115 towards the pool return port 121, while the second nozzle 119 comprises a first section that narrows from the pump inlet port 115 towards the pool return port 121 and a second section opposite the first section that narrows towards the first section (and the pump inlet port 115). In some embodiments, the second nozzle 119 extends at least partially into the pool return port 121 and narrows from the pool return port 121 towards the pump inlet port 121. Particular embodiments of the second nozzle 119 are also configured to allow efficient ozone or other chemical injection into the pool water. Such a method of introducing ozone or other chemicals into the pool water also eliminates the clumping of air in the return piping resulting in gurgling noises and loss of effectiveness that is inherent in convention ozone injection methods.

Figure 14C:
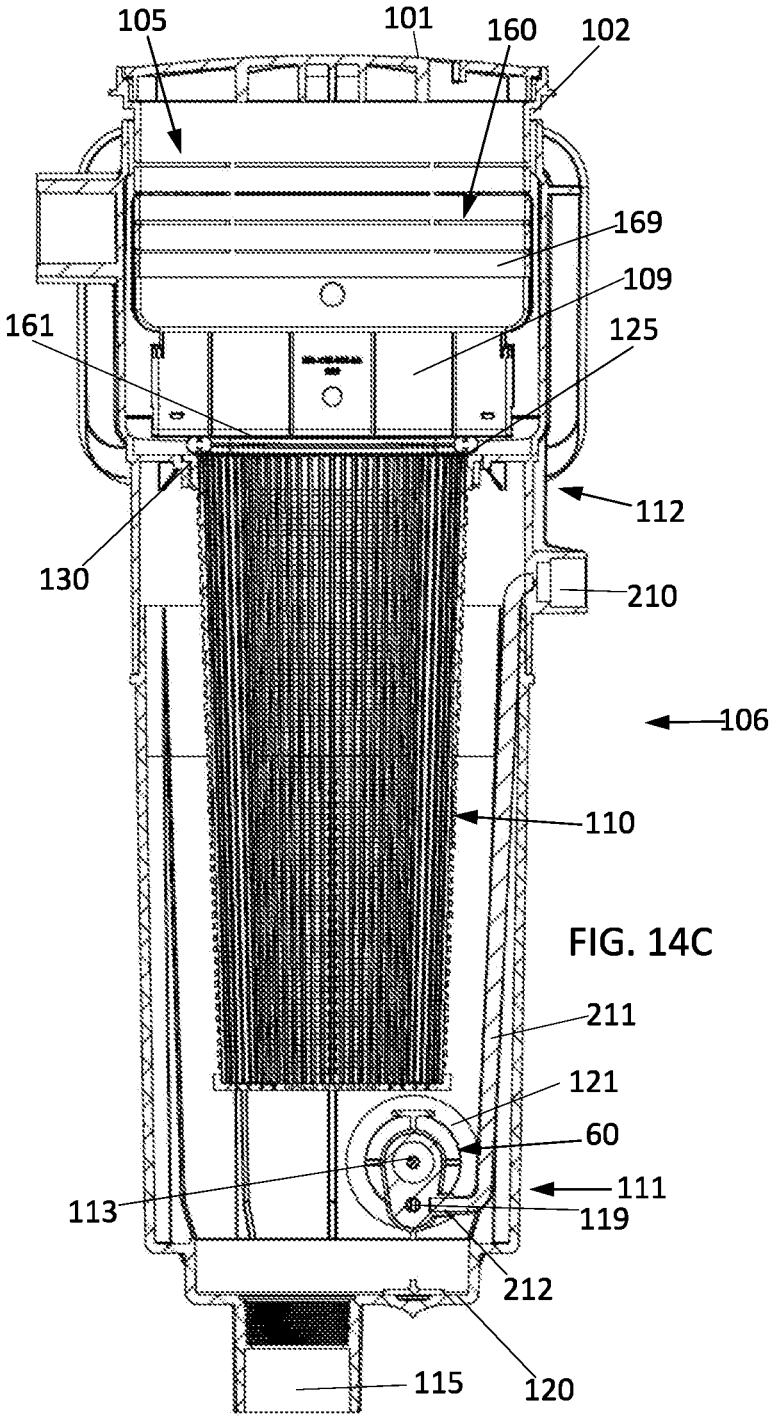
FIG. 14C is a cross sectional view of a third embodiment of a pool skimmer system taken along line H-H of FIG. 12.

FIG. 14C depicts a non-limiting embodiment of a pool skimmer system 106 comprising a tube 211 coupled to the venturi system 60 and configured to allow transfer of ozone or other chemicals into the pool water through the venturi system 60. More particularly, a venturi system 60 may comprise a tube coupling port 212 configured to removably or fixedly couple to a tube 211. In some embodiments, the tube coupling port 212 is angled approximately 90 degrees relative to the nozzles of the venturi system 60. According to some aspects, the tube coupling port 212 (and tube 211) feeds into or is in direct fluid communication with the second nozzle 119 of the venturi system 60. In other embodiments, the tube coupling port 212 (and tube 211) feeds into or is in direct fluid communication with the first nozzle 113 of the venturi system 60.

Figure 14D:
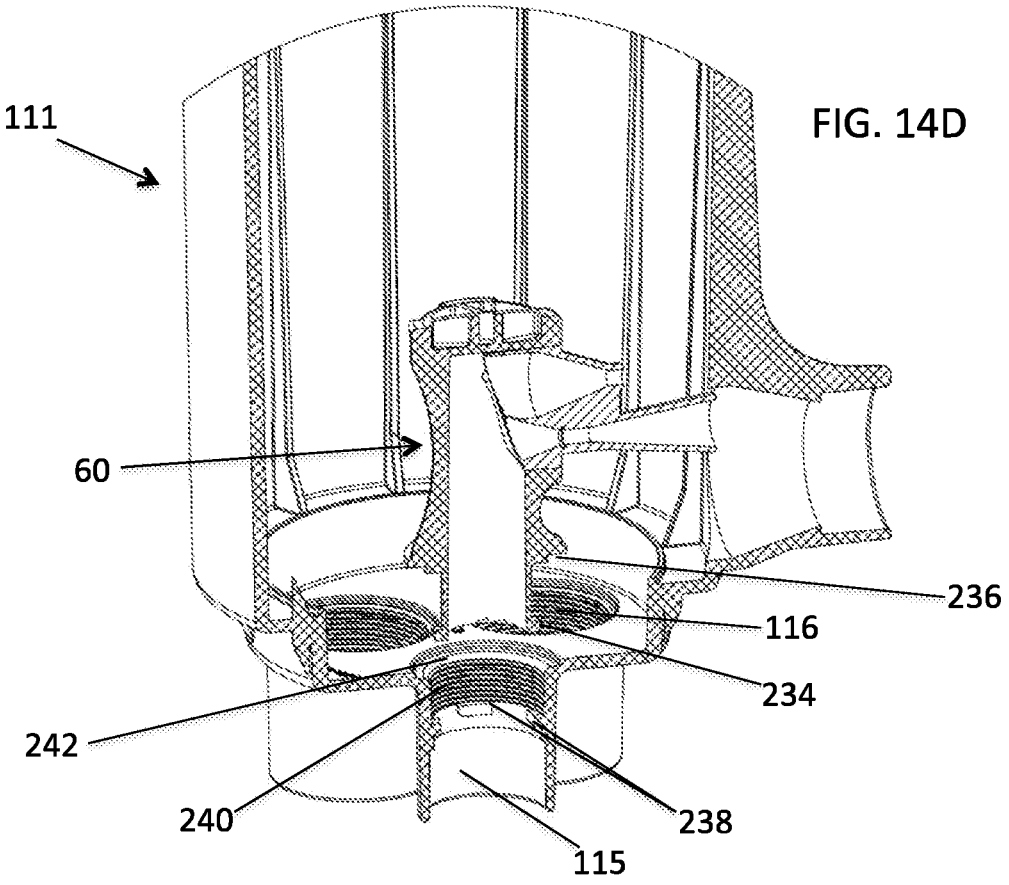
FIG. 14D is a close-up view of the cross sectional view similar to FIG. 14B with several components removed and the venturi system nozzle detached.
Figure 14E:
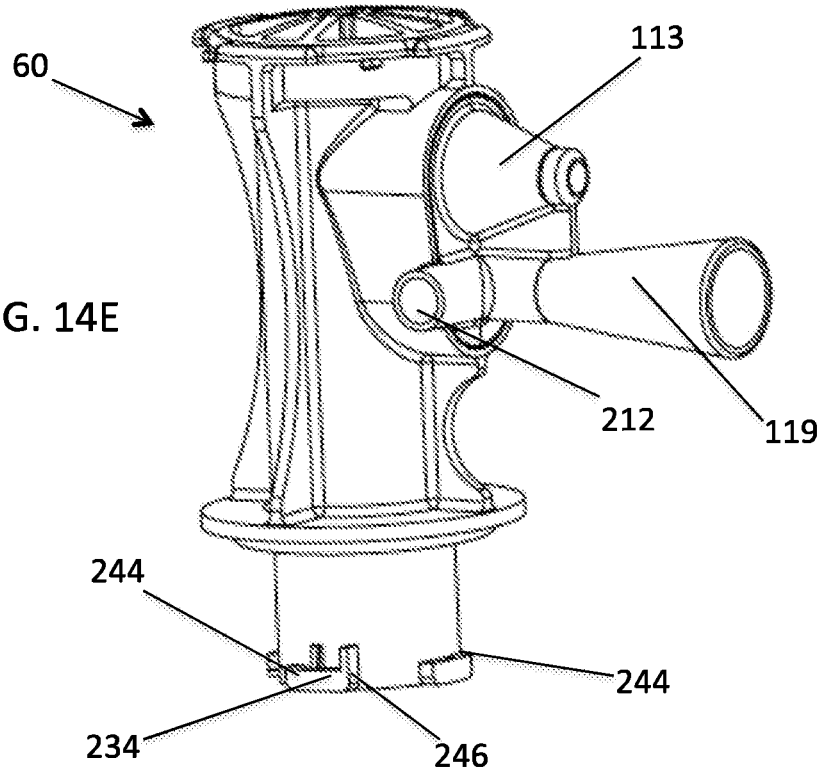
FIG. 14E is a perspective view of the venturi system and nozzles.
Figure 14F:
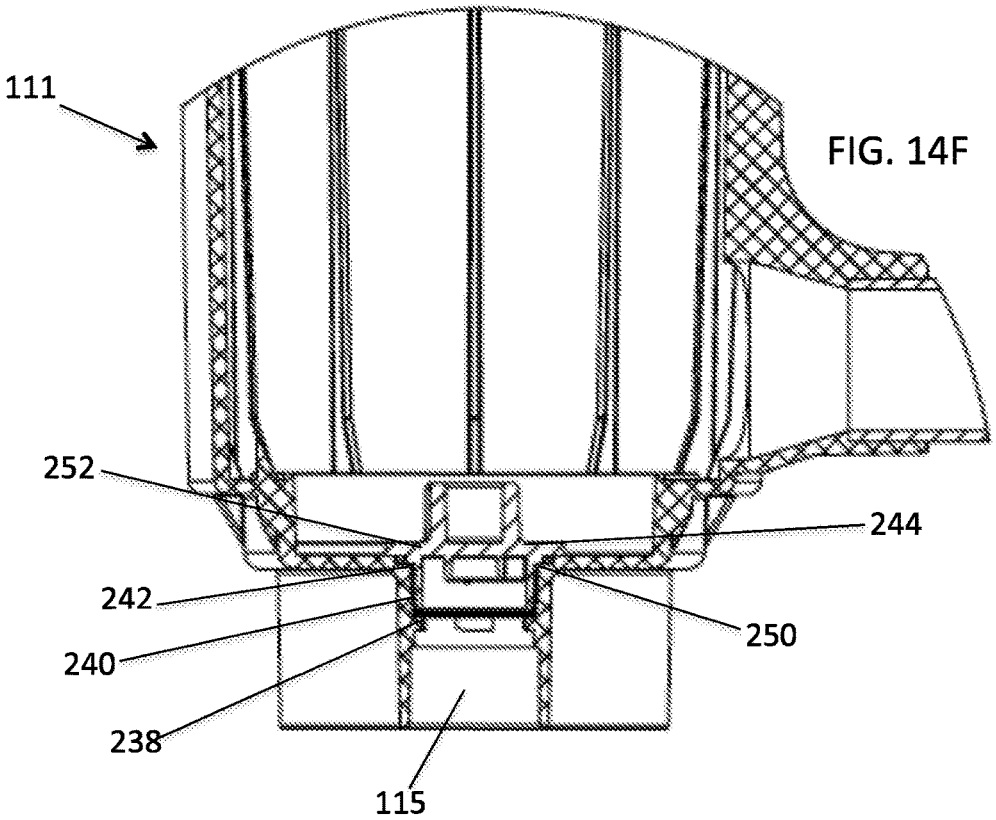
FIG. 14F is a close-up view of the cross sectional view similar to FIG. 14B with several components removed and a pressure-test plug in place of the venturi System and nozzles.

FIG. 14D illustrates a close up view of the cross sectional view of the skimmer housing 111 similar to FIG. 14B with the basket 110 and return pipe 114 removed for clarity, and the venturi system 60 detached from the pump inlet port 115. The pump suction ports 116 and the pump inlet port 115 each include internally threaded openings into the skimmer housing 111. Within the pump inlet port 115, in addition to and below the internal threads 240, are bayonet lugs 238 extending inward of the inside surface of the pump inlet port 115 and the internal threads 240. By placing the internal threads between the bayonet lugs and the upper end 242 of the pump inlet port 115, the internal threads are available for an externally threaded pressure test plug 244 (FIG. 14F) to be threadedly coupled into the upper end 242 of the pump inlet port 115. Use of a pressure test plug allows the pump inlet port to be used to block the pump inlet water line so that water pressure can be applied to the system during installation to ensure that undesired leaking is not occurring. In particular embodiments the externally threaded portion of the pressure test plug has a height less than the distance between bayonet lugs and the upper end of the pump inlet port 115, though this is not a requirement. In such embodiments, a lower side 250 of a ring 252 that extends around the pressure test plug 244 seats against the bottom of the skimmer housing 111 and the upper end of the pump inlet port 115.

Conventionally where a pressurized nozzle is mounted in the floor of a skimmer housing, it is threadedly engaged with the pump inlet water line using the same threads conventionally used for the pressure test plug. One difficulty of this type of configuration, however, is proper alignment of the nozzle with the pool return pipe. If the nozzle is threaded too far or not enough, it will not be properly aligned with the pool return pipe. Optimally, the primary nozzle is directed parallel with the pool return pipe to expel as much force and water directly in line with the pool return pipe. In particular embodiments where a bayonet connector is used, because the bayonet lugs 238 and the bayonets 234 have discrete positions, the bayonets 234 including a bayonet ledge 244 and a bayonet stop 246 (FIG. 14E) to guide and engage the bayonet lugs 238, and are not merely a continuous threaded channel, the end, fully tightened position of the bayonet connector of the venturi system 60 and pump inlet port 115 can ensure the venturi system 60 nozzles 113, 119 are properly aligned with the pool return pipe 114 (FIG. 14B).

In one or more embodiments, a pool skimmer system 106 further comprises an outer port 210 configured to couple to pipes, tubing, and the like. In some embodiments, the outer port 210 is positioned on the upper skimmer housing 12. The outer port 210 is further configured to couple to a tube 211 opposite the venturi system 60 and transfer ozone or other chemicals from through the outer port 210 into the tube 211 such that ozone or other chemical may then be transferred through the tube 211 and into the venturi system 60 for distribution into the pool. According to some aspects, the outer port 210 is in fluid communication to an ozone generator or other chemical distributor at a location remote with respect to the pool skimmer system 106. The ozone generator or other chemical distributor may be metered and there is a draw on the tube 211 any time the skimmer is operating. The flow from the ozone generator or other chemical distributor may be controlled at any level, from off to full, with a valve or other device known in the art. It is noted that is the tube 211 is removed from the venturi system 60, the venturi system 60 will draw water into the venturi system through the tube coupling port 212, thus not effecting the overall performance of the venturi system 60.

Figure 13:
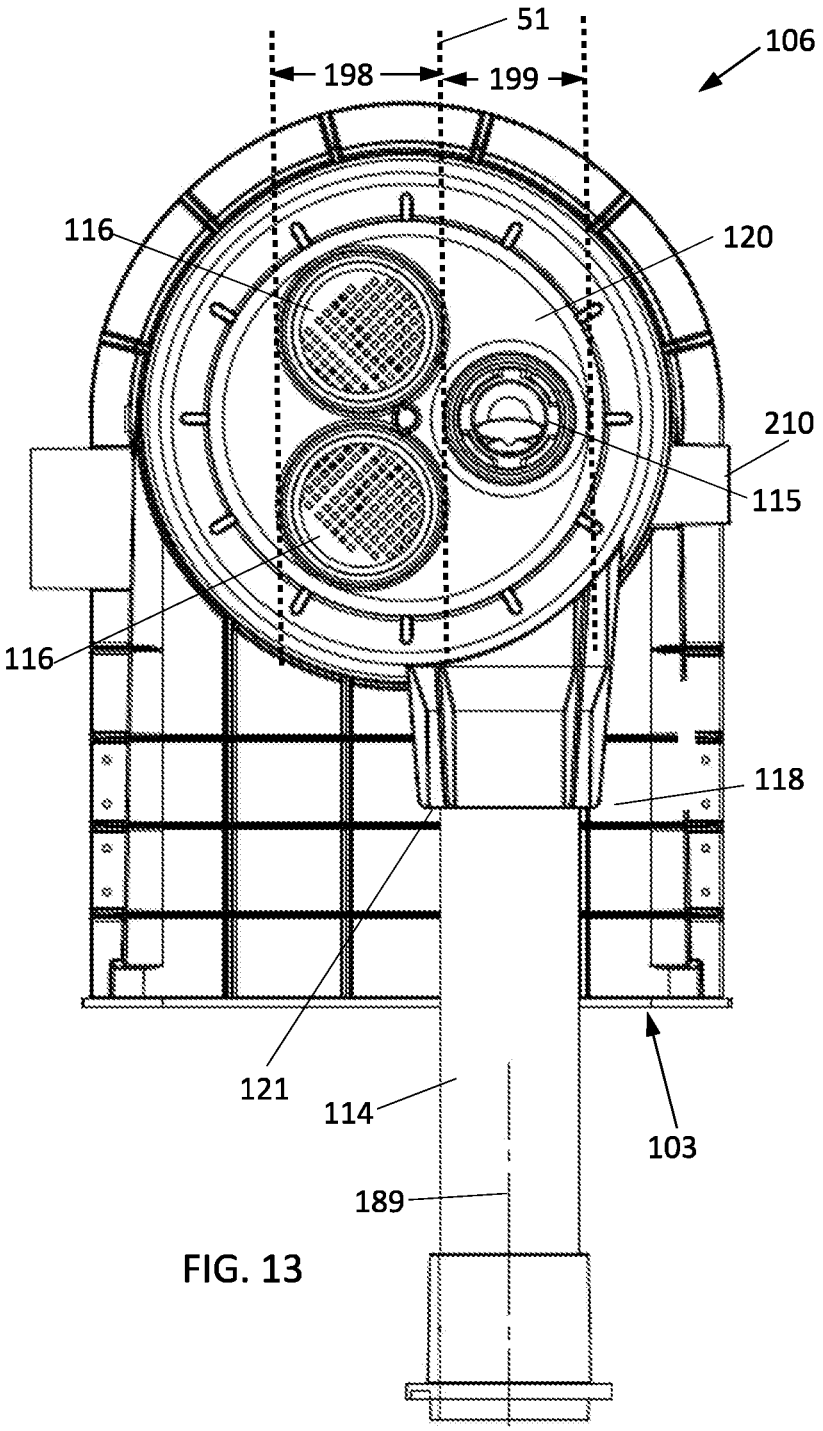
FIG. 13 is a bottom view of a third embodiment of a pool skimmer system.

According to some aspects, both the one or more pump suction ports 116 and the pump inlet port 115 extend through a skimmer bottom 120 of the skimmer housing. For example, the non-limiting embodiment shown in FIG. 13 depicts a bottom view of a pool skimmer system 106 with two pump suction ports 116 and one pump inlet port 115 extending through the skimmer bottom 120 of the skimmer housing. Positioning the pump inlet port 115 on the skimmer bottom 120 is advantageous for multiple reasons. First, this positioning allows the first nozzle 113 to be positioned proximate or closer to the pool return port 121 than if the pump inlet port and nozzle were positioned in a side-wall of the housing as is conventional. This increases the effectiveness of the venturi water draw through the skimmer and eliminates the need for additional parts required in conventional horizontally opposed venturi skimmer ports in the side-wall of the housing. For embodiments disclosed herein, no adjustment of the venture nozzles to align them with the pool return port 121 is required but just a simple twist lock preset alignment for consistent operation every time. Second, positioning of the pump inlet port 115 on the skimmer bottom 120 allows for more efficiently arranged pump inlet 115 and pump suction 116 ports. This provides convenient access to all of the ports of the pump inlet port 115 and pump suction ports 116 without the need to remove any components (to, for example, hook up a vacuum hose). Third, such a configuration allows for easier plugging of one or all of the pump inlet port 115 and/or the pump suction ports 116 when pressure testing major lines during or after construction.

In addition to the advantages of being positioned on the skimmer bottom 120, various embodiments may further comprise one or more pump suction ports 116 that are offset in positioning from the pump inlet port 115. For example, in the non-limiting embodiment shown in FIG. 13, the pump suction ports 116 extend through a more middle portion 198 of the skimmer bottom 120, while the pump inlet port 115 extends through a side portion 199 of the skimmer bottom 120 offset from the middle portion 198. In other words, the pump inlet port 115 and the one or more pump suction ports 116 are separated by a theoretical plane 51 extending from the basket opening 161 to skimmer bottom 120 such that the pump inlet port 115 and the pool return port 121 are aligned with each other but offset from the one more pump suction ports 116 to provide vertical access to each without interfering with the others. It is noted that although the walls of the one or more pump suction ports 116 and the pump inlet port 115 may overlap or intersect the theoretical plane 51, the openings of the one or more pump suction ports 116 and the pump inlet port 115 are separated by the theoretical plane 51. Such a configuration improves overall flow and efficiency of the skimmer system 106 and the venturi system 60. This configuration also allows access to suction ports 116 without interfering with the venturi pump inlet port 115.

Figure 11:
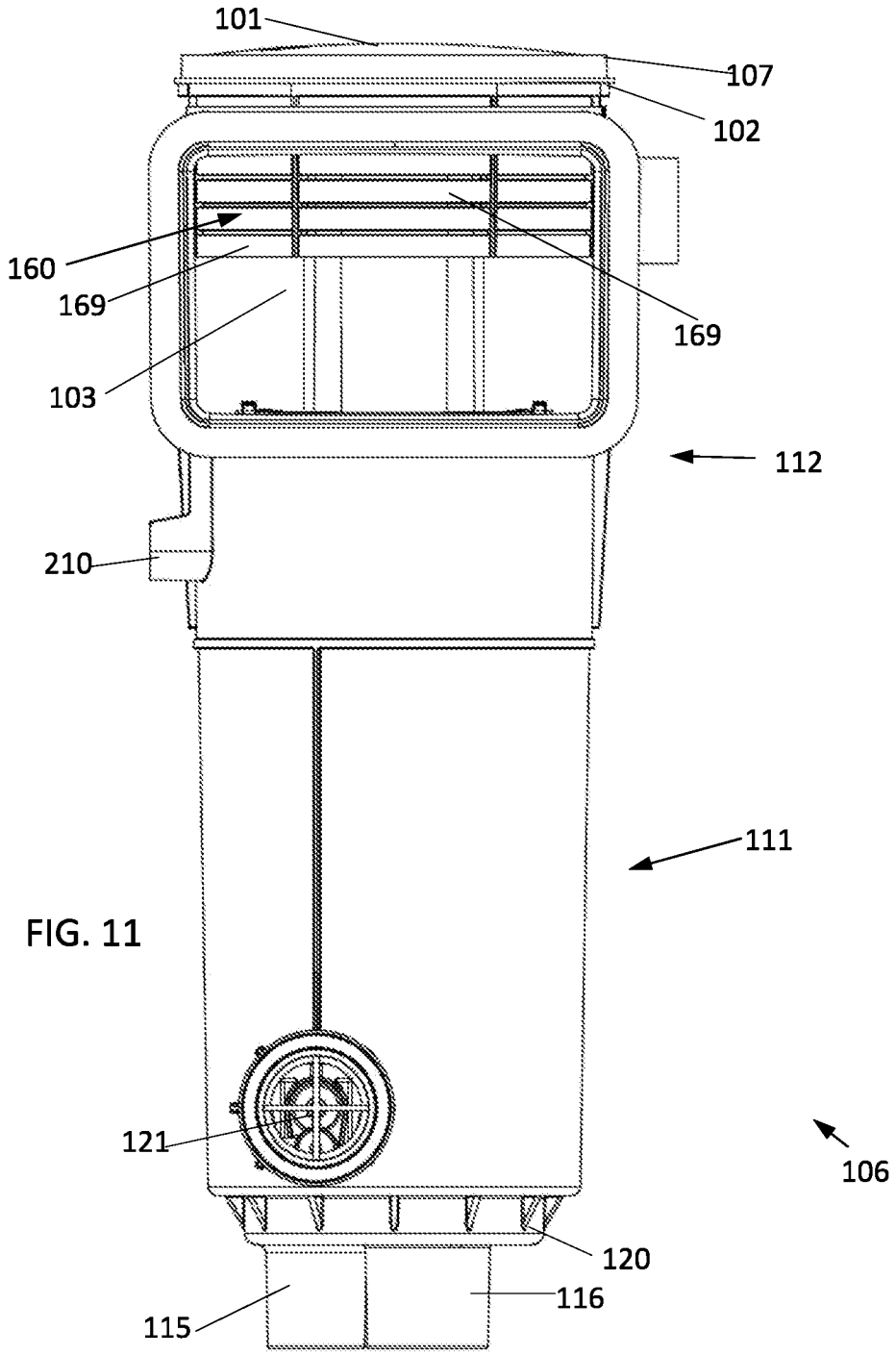
FIG. 11 is a front view of a third embodiment of a pool skimmer system with a weir door open and the segmented deck ring section visible.
Figure 12:
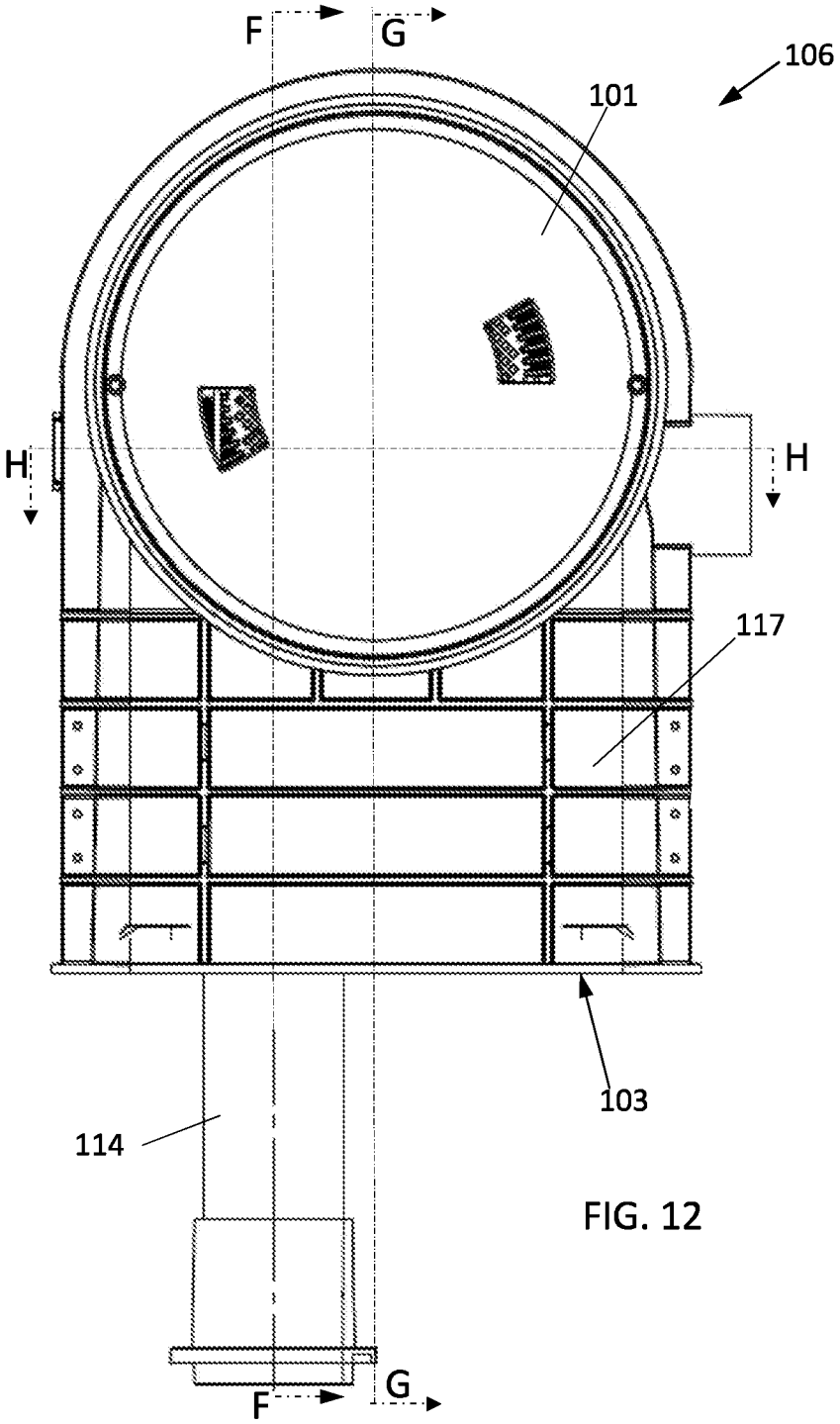
FIG. 12 is a top view of a third embodiment of a pool skimmer system.

One or more embodiments of a pool system further comprise a deck ring 102 comprising a segment deck ring section 160. FIGS. 11, 14A, and 14B depict non-limiting embodiments of a deck ring 102 comprising a segmented deck ring section 160. It is noted that although the segmented deck ring section 160 is shown with reference to pool skimmer system 106, breakaway rings 169 and sections 160 may be applied to any of the deck rings referenced throughout this document without departing from the scope of this disclosure. In some embodiments, the segmented deck ring section 160 extends only part way around a bottom end of the deck ring 102, thus positioning the segmented deck ring section 160 towards or proximate the pool throat opening 103 of the skimmer housing. In other embodiments, the segmented deck ring section 160 extends entirely around a bottom end of the deck ring 102.

According to some aspects, a segmented deck ring section 160 comprises a plurality of a breakaway sections or rings 169 and allows a user to adjust the sizing and height of a deck ring 102 to meet the needs of each unique and specific skimmer system. For example, a deck ring 102 having a segmented deck ring section 160 may comprise a longer height that typical deck rings such the deck ring 102 fits the dimensions of a thicker pool deck. If, however, the deck ring 102 needs to be shortened to meet the requirements and dimensions of a thinner deck, a user may break off one or more breakaway rings 169 from the segmented deck ring section 160 to shorten a height of at least a portion of the deck ring 102. Furthermore, the segmented deck ring section 160 allows for maximum open area in the pool throat opening 103 for clearance, as well as protection from construction materials fowling the skimmer during construction and eventual operation. Because the overflow port is proximate to the tangent of the deck rings, removing one or more breakaway rings 169 also allows for a larger overflow exit from the skimmer without potential partial blockage interfering with possible large amounts of water typical in areas with heavy amounts of rain.

Figure 10:
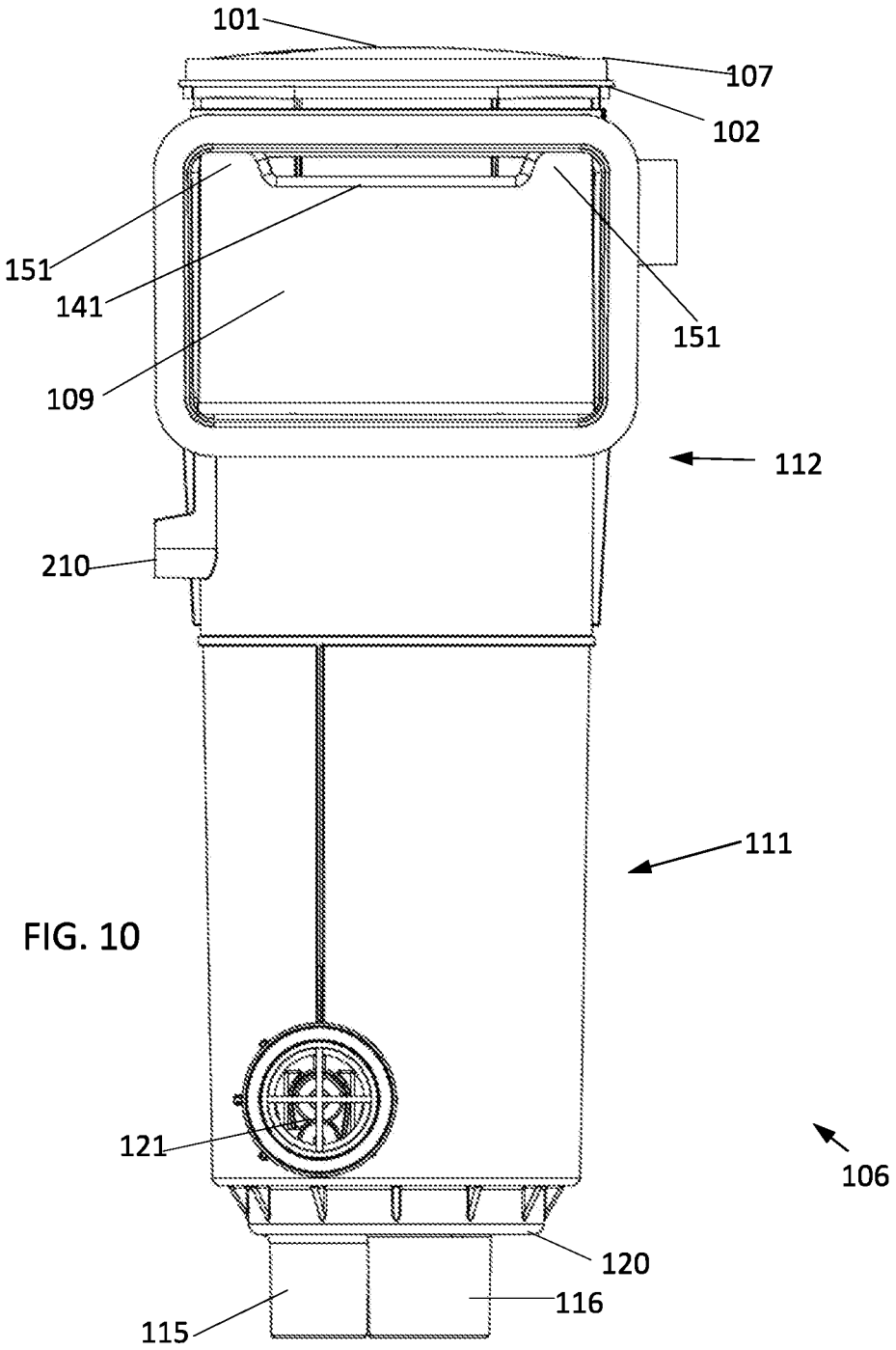
FIG. 10 is a front view of a third embodiment of a pool skimmer system with a weir door closed.

One or more embodiments of a pool skimmer system 106 further comprise an improved weir door 109. It is noted that the weir door 109 may be applied to any pool skimmer systems disclosed herein or otherwise known in the art without departing from the scope of this disclosure. FIG. 10 depicts a non-limiting embodiment of a weir door 109. According to some aspects, a weir door 109 comprises a recessed top edge 141 and at least one winged top edge 151. In the non-limiting embodiment According to some aspects, a weir door 109 comprises a recessed top edge 141 disposed between two winged top edges 151. The recessed top edge 141 and the winged top 151 may be positioned on the weir door 109 opposite bottom edge or pivot edge of the weir door 109 pivotally coupled to the throat opening 103. Such a configuration is advantageous because it allows the weir door 109 to act as a self-regulating door to maintain water depth over the weir door 109 as the flow changes. Maintaining a deeper flow over the weir door 109 increases the effectiveness of debris entering the skimmer system 106.

According to some aspects, a pool return port 121 and/or a return pipe 114 extend from the skimmer housing. In a worst case scenario where the basket 124, channel 145, and venturi system 60 become clogged, a pool return port 121 may create a suction from the pool into the skimmer housing through the return pipe 114. Contemplated in this disclosure are various pool skimmer systems configured to prevent injury to pool users even if the suction from the pool into the skimmer housing through a return pipe is created. By lengthening and/or angling the pool return port and/or the return pipe in a direction not straight to the pool, a distance between the pool and the skimmer housing (and pump suction ports 116) is increased. In more particular embodiments, the return pipe system (or better stated the shortest travel distance within the return pipe system) is between approximately 12 and approximately 18 inches in length between the skimmer housing and an entrance to the pool.

In other particular embodiments, the return pipe system is at least 16 inches in length and in other particular embodiments the return pipe system is at least 18 inches in length.

Figure 17:
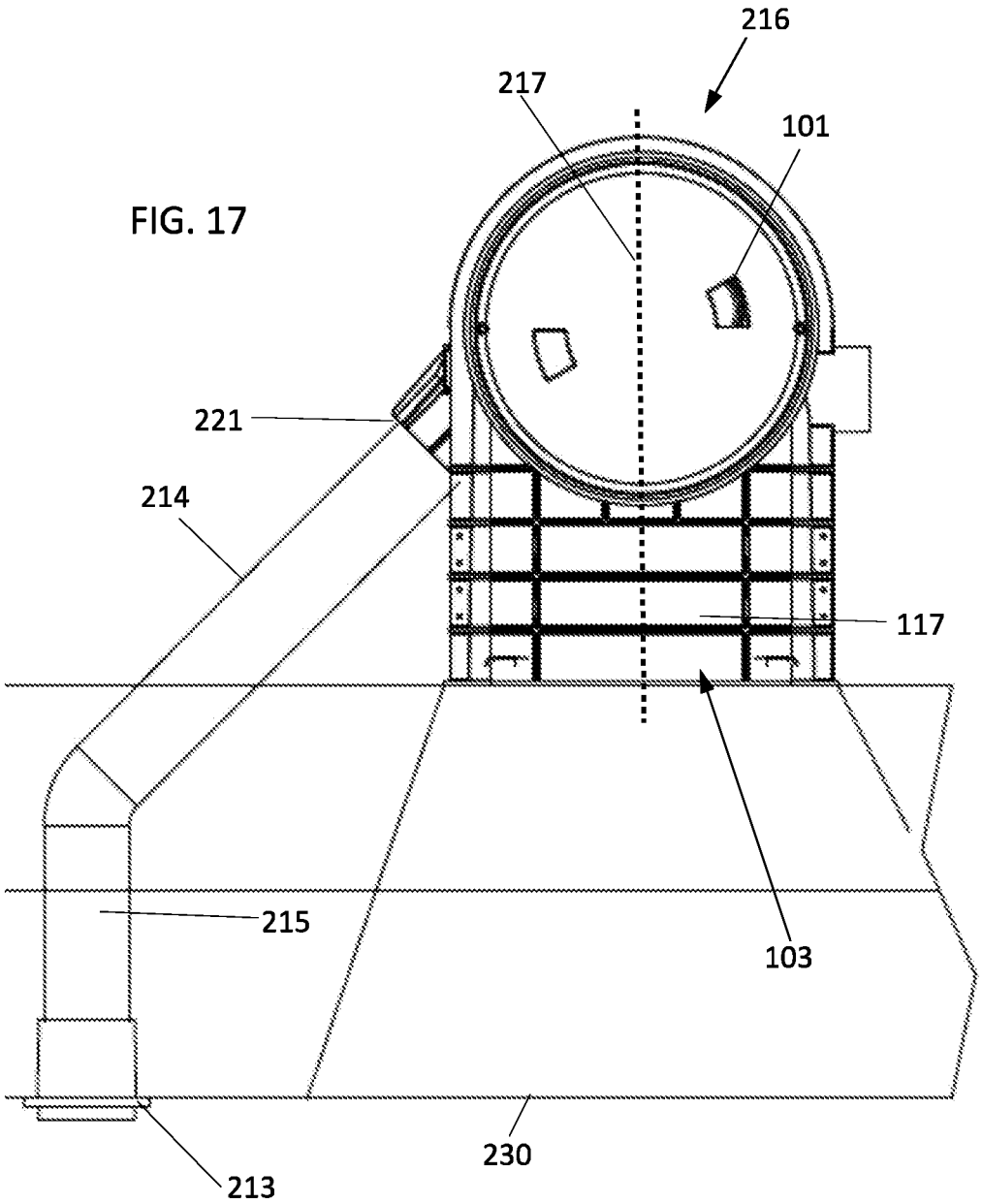
FIG. 17 is a top view of a fourth embodiment of a pool skimmer system with a first angled pool return pipe system.

In some embodiments, a pool skimmer system comprises at least one return pipe at an angle less than 90 degrees from the pool return fitting 213 and the wall of the pool 230 to which the pool return fitting 213 is coupled. For example, FIG. 17 depicts a non-limiting embodiment of a pool skimmer system 216 comprising a return pipe system comprising at least two main return pipes. A first return pipe 215 of the return pipe system is coupled to the pool return fitting 213 substantially perpendicular to the pool wall 230 to which the pool return fitting 213 is coupled. A second return pipe 214 of the return pipe system is coupled to the first return pipe 215 and is angled at an angle that is less than 90 degrees relative to the pool wall 230 to which the pool return fitting is coupled. The second return pipe 214 may, for example, be angled between 15 and 75 degrees relative to the pool wall 230, between approximately 30 and 60 degrees relative to the pool wall 230, or approximately 45 degrees relative to the pool wall 230. In some embodiments, the second return pipe 214 is coupled to the first return pipe 215 and the pool return port 221. The pool return port 221 is angled on the skimmer housing to accommodate the angle of the second return pipe 214 described above. In some embodiments, a return pipe 214 is coupled to the pool return port 221 and angled with respect to a plane 217 extending through a center of the pool throat opening 103 and a center of the skimmer housing.

Figure 18:
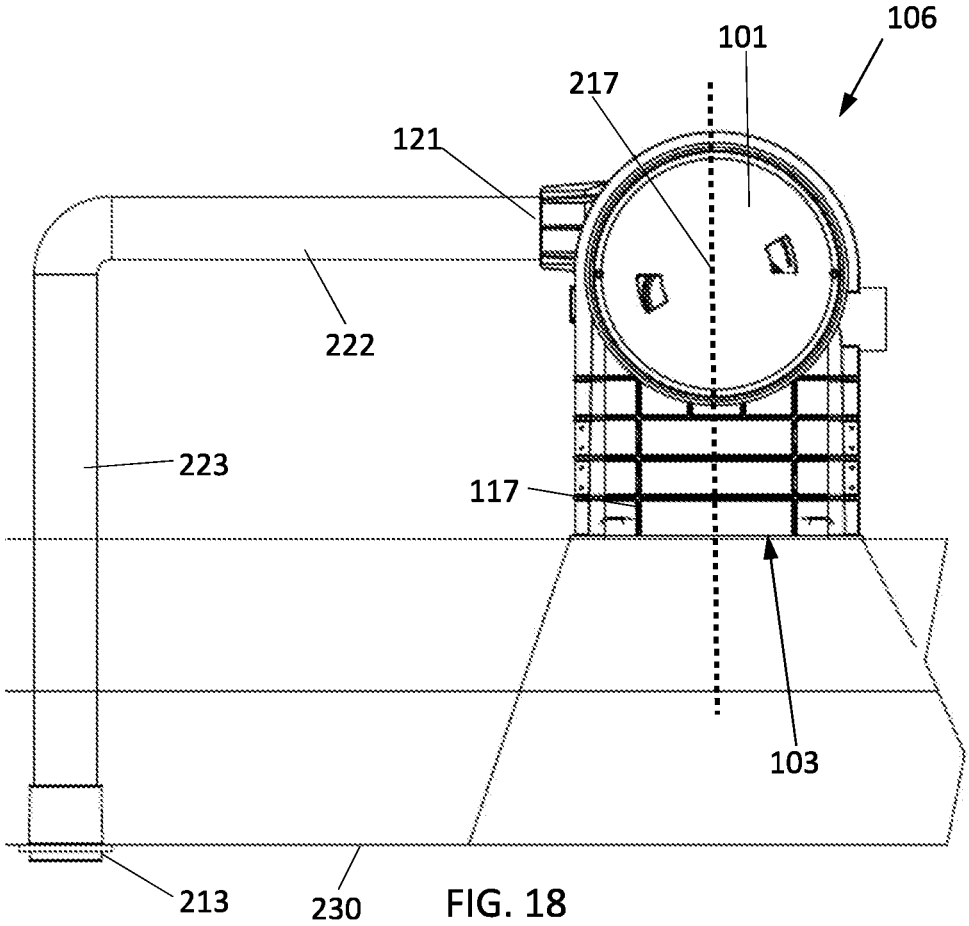
FIG. 18 is a top view of a fifth embodiment of a pool skimmer system with a second angled pool return pipe system.

In other embodiments, such as the non-limiting embodiment shown in FIG. 18, a pool skimmer system may comprise a return pipe system comprise a first return pipe 223 and a second return pipe 222 coupled first return pipe 223 and the pool return port 121. According to some aspects, the first return pipe 223 is coupled to the pool return fitting 213 substantially perpendicular to the pool wall 230 to which the pool return fitting 213 is coupled. A second return pipe 223 may extend between the first return pipe 223 and the pool return port approximately parallel (or 0 degrees) to the pool wall 230 which the return fitting 213 is coupled.

Figure 15:
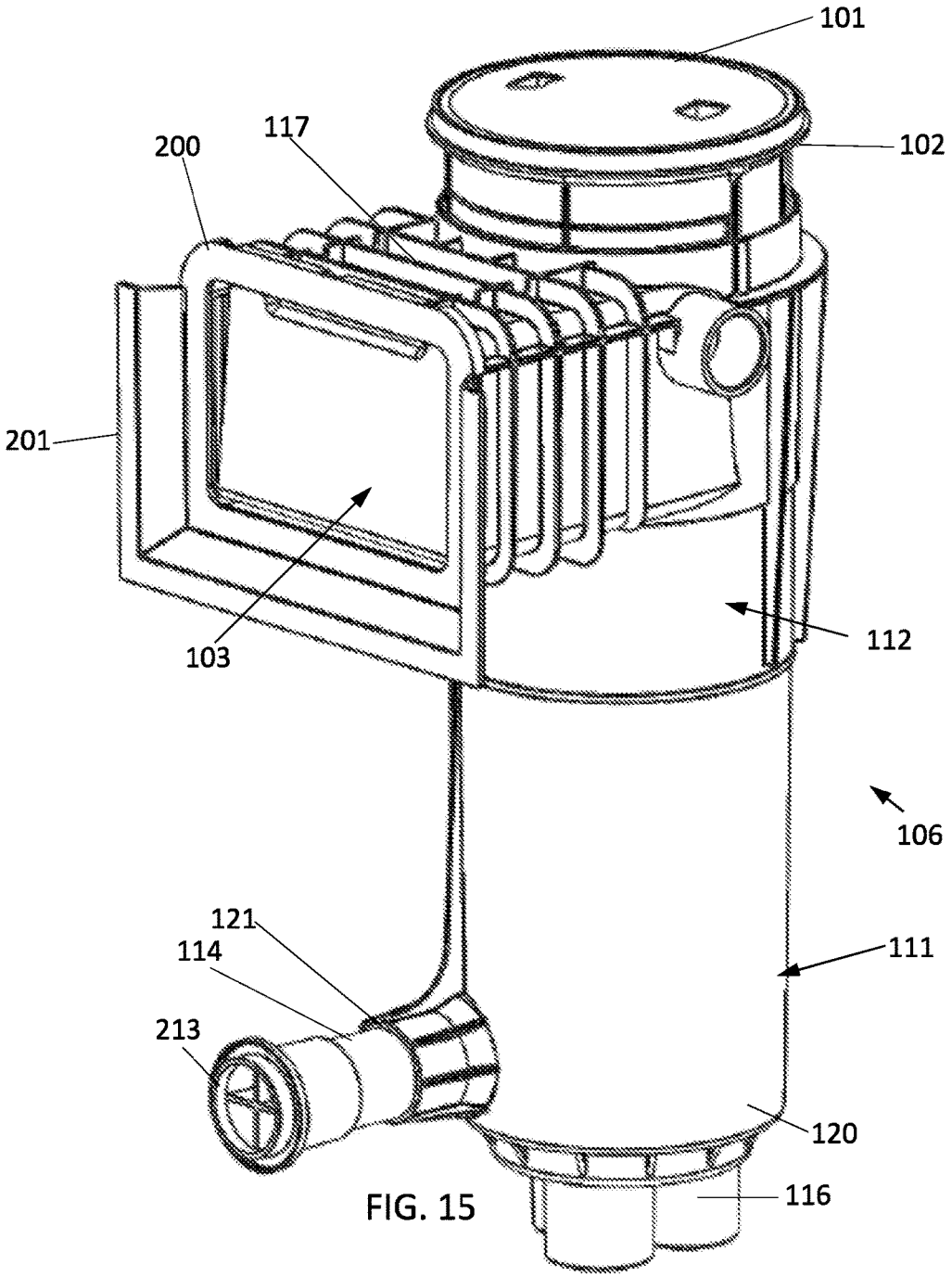
FIG. 15 is a perspective view of a third embodiment of a pool skimmer system with a first embodiment of a snap-on finish ring.
Figure 16:
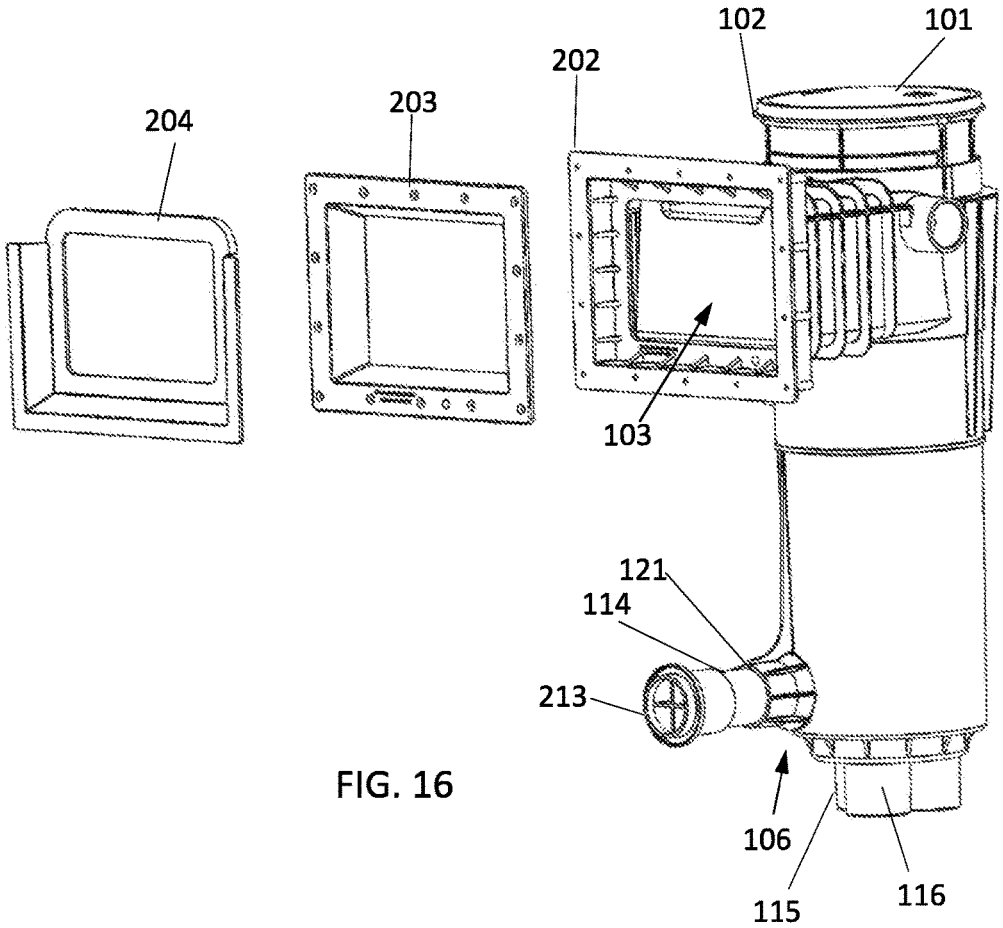
FIG. 16 is a perspective view of a third embodiment of a pool skimmer system with an exploded view of a second embodiment of a snap-on finish ring.
Figure 19:
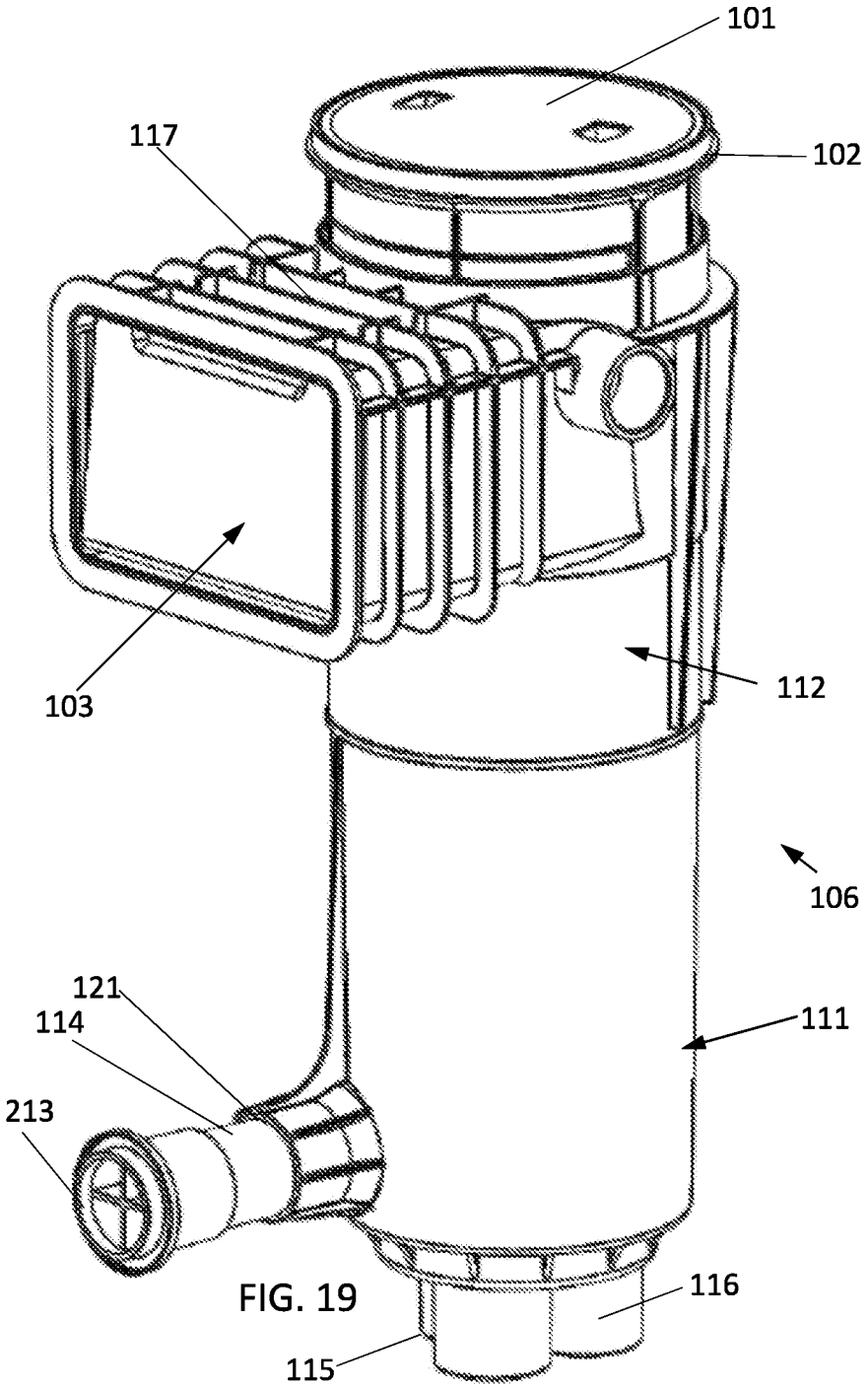
FIG. 19 is a perspective view of a third embodiment of a pool skimmer system without any snap-on finish rings.

In one or more embodiments of a pool skimmer system contemplated by this disclosure, a pool skimmer system comprises snap-on finish ring coupled to a terminating end of the pool throat 103. As use herein, a snap-on finish ring references a ring having one or more biased tabs configured to engage with one or more tabs, ribs, slots or holes on the pool skimmer housing to removably couple the finish ring to the skimmer housing. A snap-on finish ring is advantageous to conventional pool skimmer system because it allows a user to quickly and efficiently replace the finish ring on the pool surface without replaces the entire skimmer system. Screws, adhesives, cement, and the like are not required to couple the snap-on finish ring to the skimmer housing. FIG. 19 shows a pool skimmer system 106 without any snap-on finish rings coupled to the skimmer system proximate the pool throat, while FIGS. 15 and 16 show two non-limiting embodiments of a snap-on finish ring. In some embodiments, such as the non-limiting embodiment shown in FIG. 15, the snap-on finish ring 200 comprises a flanged edge 201 partially surrounding the snap-on finish ring 200 and is configured to snap-on directly to a terminating end of the pool throat. According to some aspects, the snap-on finish ring 200 comprises three flanged edge 201 sides, with the top edge being devoid of a flanged edge. In other embodiments, such as the non-limiting embodiment shown in FIG. 16, the snap-on finish ring 204 snaps on to a coupling ring 203. The coupling ring 203 may be configured to couple to a pool throat ring 202 with, for example, screws. The pool throat ring 202 may comprise a throat ring of conventional pool systems or may be adapted for specific use with the snap-on finish ring 204. The pool throat ring 202 may be integrally formed with the pool throat or detachably coupled to the pool throat. In some embodiments, a user may retrofit a snap-on ring 204 to a standard pool throat ring 202 by first coupling a coupling ring 203 to the pool throat ring 202, and then snap-fitting the snap-on finish ring 204 to the coupling ring 203.

Figure 20:
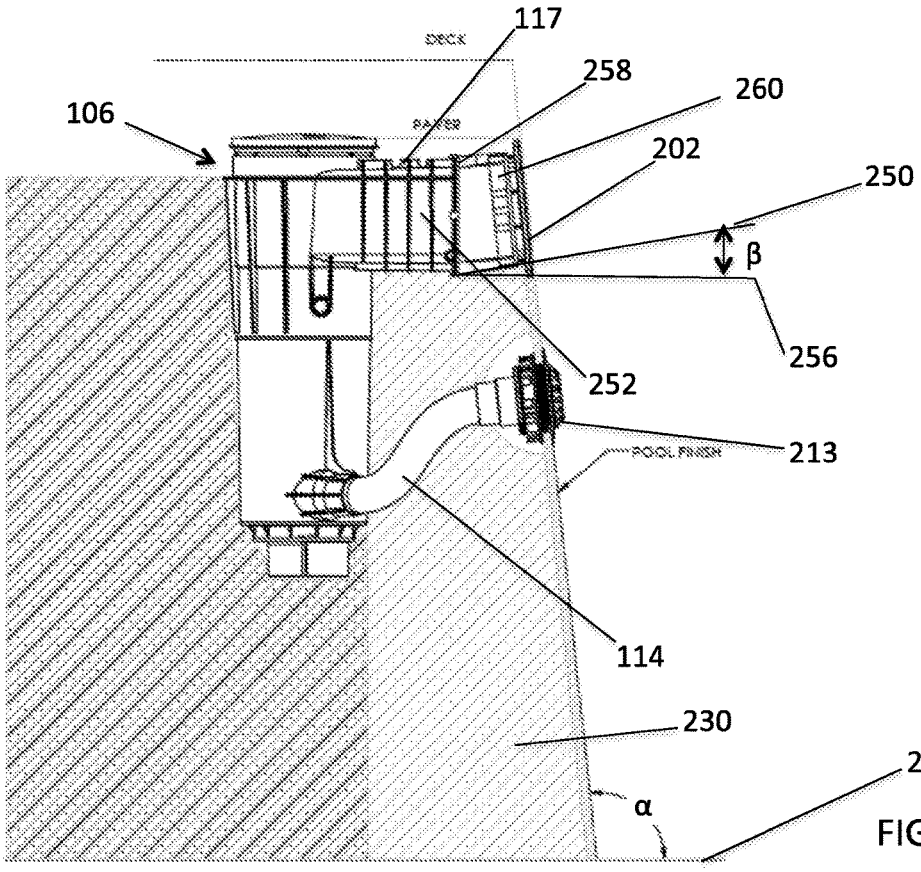
FIG. 20 is a side-view of a partially cross-sectioned pool wall showing a pool skimmer and skimmer door housing.

Pool skimmers conventionally include a pool throat that extends perpendicularly outward from the skimmer housing in the direction of the pool and the skimmer housing is installed with the pool throat parallel to the ground so that the pool throat is horizontal. However, a fiberglass pool wall is not generally manufactured with the walls perpendicular to the ground. With reference to FIG. 20, to the contrary, they are generally manufactured with an angle a between the floor 254 and the side-wall 230 of between 93° to 99°, or approximately 96°, with the variation of ±3° from 96° being due to manufacturing tolerances. As a result, the opening to the pool throat 252 that faces the entrance into the pool through the pool wall 230 is parallel to the pool wall, but not plumb to the pool water level; it is off plumb by approximately 6 degrees (with the ±3° tolerance). However, because the pool throat ring 202 mates directly to the pool throat 252 opening, it's opening is also conventionally not perpendicular to the pool wall. To adapt to this, installers must take extra care to seal up the area under the deck at the top of the skimmer pool throat ring 202. This prevents the pool designer from designing a pool with a skimmer opening on the pool wall surface without additional work for the installer, and limits the types of surfaces that can surround the pool throat ring without leaving a gap due to the difference in the angle and presenting an undesirable look about the deck lid access point.

In the particular embodiment illustrated in FIG. 20, to allow for the skimmer pool throat 252 being parallel with the ground, yet still enable the plane of the pool throat ring 202 opening to be mounted parallel with the surface of the pool wall 230, an angled pool throat extension 250 is mounted to the pool end of the pool throat 252 between the pool throat ring 202 and the pool throat 252. The pool throat ring 202 then mounts to the angled pool throat extension just as it would have conventionally mounted to the pool throat 252. However, with the angled pool throat extension 250, the conventional skimmer housing can be installed as normal without the requirement of additional work to compensate for the non-perpendicular pool wall. The angled pool throat extension 250, is tilted above horizontal 256 by angle β, in a particular embodiment approximately 6 degrees (including the ±3 degree tolerance), so that the angled pool throat extension 250 mates with the angled wall and allows the skimmer to be plumb with the pool water 230. The pool throat ring 202 is mounted to the pool throat extension 250 giving the pool throat ring 202 approximately the same angle in relation to the pool floor 254 as the pool wall 230. By configuring the angled pool throat extension 250 so that the angle β rises a bottom surface of the pool throat extension in relation to horizontal 256 which is parallel to the pool throat 252 and coupling it to the pool throat opening at the pool end of the pool throat 252, the result is that the plane extending over the opening at the input 258 to the angled pool throat opening 250 and the plane extending over the opening at the output 260 of the angled pool throat opening 250 also have the same angle β as the difference between their respective planar angles in relation to horizontal 256. In other words, the plane parallel to the opening at the input 258 is not parallel to the plane parallel to the opening at the output 260 of the angled pool throat opening.

A conventional pool return pipe and pool return fitting extends from the skimmer housing directly to the pool, in the most direct path to the pool, or in a line perpendicular to the housing or perpendicular to a line tangent to the housing if the housing is round. For a fiberglass pool installation, this creates disruption with the proper operation of a swimming pool skimmer because the wall of the fiberglass pool is not perpendicular to the ground and, therefore, not perpendicular to the surface of the water. The water expressed from the pool return fitting into the pool, therefore, is angled toward the surface of the swimming pool and tends to push away debris that would otherwise be drawn to the skimmer through normal skimmer action. Where the pool return fitting sends water into the pool parallel with the surface of the water, this is not a problem, but becomes a problem when the pool return fitting mates with the wall of the pool at an acute angle to the surface of the pool.

With reference to FIGS. 17 and 20, FIG. 20 illustrates an installation of a skimmer into a fiberglass pool where the pool return and pool return fitting 213 is coupled to the skimmer assembly 106 through a pool return pipe 114. Rather than have the pool return angled to directly enter the swimming pool in the shortest path from the skimmer housing to the pool, as explained with reference to FIGS. 17 and 18 above, the pool return pipe(s) may be angled away from being directly below the pool throat ring 202 so that the pool return fitting 213 is off to the side of the pool throat ring. Although the specific distance away from the side of the plane 217 extending through the center of the pool throat opening 103 is not critical, in particular embodiments the pool return fitting 213 is positioned on the pool wall outside a footprint extending below the pool throat opening 103. In other particular embodiments, the pool return fitting 213 is positioned on the pool wall to a side of the center plane 217 of the pool throat opening 103 at least twice the distance from the center of the pool throat opening 103 to a side of the pool throat opening 103. In other particular embodiments, the pool return fitting is positioned on the pool wall to a side of the center plane 217 of the pool throat opening 103 a distance of between 2-5 times the distance from the center of the pool throat opening 103 to the side of the pool throat opening 103.

It will be understood that implementations are not limited to the specific components disclosed herein, as virtually any components consistent with the intended operation of a method and/or system implementation for a pool skimmer system may be utilized. Accordingly, for example, although particular housings, baskets, ports, pumps, and the like may be disclosed, such components may comprise any shape, size, style, type, model, version, class, grade, measurement, concentration, material, weight, quantity, and/or the like consistent with the intended operation of a method and/or system implementation for a pool skimmer system may be used.

In places where the description above refers to particular implementations of a pool skimmer system, it should be readily apparent that a number of modifications may be made without departing from the spirit thereof and that these implementations may be applied to other pool skimmer systems. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A pool skimmer, comprising:

a skimmer housing comprising a pool throat opening, a deck throat opening, a basket opening within the skimmer housing, a skimmer bottom distal the deck throat opening, one or more pump suction ports extending through the skimmer bottom, and a pool return port extending through a sidewall of the skimmer housing; and a venturi system comprising:

a pump inlet port extending through the skimmer bottom, the pump inlet port comprising an upper end and bayonet lugs extending inward of an internal surface of the pump inlet port, the pump inlet port further comprising an internally threaded surface between the bayonet lugs and the upper end of the pump inlet port; and at least a first nozzle on a nozzle housing comprising bayonets on an external surface of the nozzle housing, the bayonets releasably engaged with the bayonet lugs of the pump inlet port;

wherein when the bayonets of the nozzle housing are in a fully tightened position in relation to the bayonet lugs of the pump inlet port, the at least a first nozzle is directed to spray toward the pool return port of the skimmer housing.

2. The pool skimmer of claim 1, wherein the venturi system further comprises at least a second nozzle operably coupled to and in fluid communication with the pump inlet port, the at least a second nozzle comprising a nozzle opening smaller than a cross-sectional area of the pump inlet port and positioned to spray fluid received through the pump inlet port into the pool return port, wherein the first nozzle is directed toward a center of the pool return port and the second nozzle is directed toward an off-center portion of the pool return port.

3. The pool skimmer of claim 2, wherein the second nozzle extends at least partially into the pool return port and narrows towards the pump inlet port.

4. The pool skimmer of claim 2, further comprising a tube coupled to the venturi system, the tube comprising a first end extending to an outer surface of the skimmer housing and a second end in fluid communication with at least one of the first nozzle and the second nozzle.

5. The pool skimmer of claim 1, wherein the pump inlet port and the internal threads of the pump inlet port are sized to receive an externally threaded pressure test plug.

6. The pool skimmer of claim 5, wherein an externally threaded portion of the pressure test plug has a height less than a distance between the bayonet lugs and the upper end of the pump inlet port.

7. The pool skimmer of claim 6, wherein a lower surface of the pressure test plug seats against at least one of a floor of the skimmer housing and the upper end of the pump inlet port.

8. The pool skimmer of claim 1, further comprising an angled pool throat extension coupled to the pool throat opening, wherein a plane parallel to an input to the angled pool throat extension and a plane parallel to an output to the angled pool throat extension are not parallel to each other.

9. The pool skimmer of claim 8, wherein the plane of the input to the angled pool throat extension and the plane of the output to the angled pool throat extension are approximately 6° different from each other.

10. The pool skimmer of claim 8, further comprising a weir door pivotally coupled to one of the pool throat opening and the angled pool throat extension.

11. The pool skimmer of claim 1, further comprising:

a channel extending from a channel lower end to a channel upper end, the channel positioned between a skimmer rim and an outer wall of the skimmer housing, the channel upper end positioned at an elevation that is least halfway between a lower wall and an upper wall of the pool throat opening; and a continuous fluid path extending from the one or more suction ports through the channel to the channel upper end when a basket is on the skimmer rim of the skimmer housing.

12. A pool skimmer, comprising:

a skimmer housing comprising a pool throat opening, a deck throat opening, a basket opening within the skimmer housing, a skimmer rim proximate the basket opening, a skimmer bottom distal the deck throat opening, one or more pump suction ports distal the deck throat opening, and a pool return port extending through a sidewall of the skimmer housing;

a venturi system comprising:

a pump inlet port extending through the skimmer bottom; and at least a first nozzle on a nozzle housing engaged with the bayonet lugs of the pump inlet port, wherein the at least a first nozzle is directed to spray toward the pool return port of the skimmer housing; and an angled pool throat extension comprising an input comprising an input plane parallel to the input and an output comprising an output plane parallel to the output, the angled pool throat extension coupled to the pool throat opening, wherein the input plane is not parallel to the output plane.

13. The pool skimmer of claim 12, wherein the input plane and the output plane are approximately 6° different from each other.

14. The pool skimmer of claim 12, the pump inlet port comprising an upper end and bayonet lugs extending inward of an internal surface of the pump inlet port, the pump inlet port further comprising an internally threaded surface between the bayonet lugs and the upper end of the pump inlet port; and the nozzle housing comprising bayonets on an external surface of the nozzle housing, the bayonets releasably engaged with the bayonet lugs of the pump inlet port; wherein when the bayonets of the nozzle housing are in a fully tightened position in relation to the bayonet lugs of the pump inlet port, the at least a first nozzle is directed to spray toward the pool return port of the skimmer housing.

15. The pool skimmer of claim 14, wherein the pump inlet port and the internal threads of the pump inlet port are sized to receive an externally threaded pressure test plug.

16. The pool skimmer of claim 15, wherein an externally threaded portion of the pressure test plug has a height less than a distance between the bayonet lugs and the upper end of the pump inlet port.

17. The pool skimmer of claim 16, wherein a lower surface of the pressure test plug seats against at least one of a floor of the skimmer housing and the upper end of the pump inlet port.

18. The pool skimmer of claim 14, wherein the venturi system further comprises at least a second nozzle operably coupled to and in fluid communication with the pump inlet port, the at least a second nozzle comprising a nozzle opening smaller than a cross-sectional area of the pump inlet port and positioned to spray fluid received through the pump inlet port into the pool return port.

19. The pool skimmer of claim 18, wherein the second nozzle extends at least partially into the pool return port and narrows from the pool return port towards the pump inlet port, and wherein the first nozzle is directed to a center of the pool return port and the second nozzle is directed toward an off-center portion of the pool return port; the pool skimmer further comprising a tube coupled to the venturi system, the tube comprising a first end extending to an outer surface of the skimmer housing and a second end in fluid communication with at least one of the first nozzle and the second nozzle.

20. A pool skimmer, comprising:

a skimmer housing comprising a pool throat opening, a deck throat opening, a basket opening within the skimmer housing, a skimmer rim proximate the basket opening, a skimmer bottom distal the deck throat opening, one or more pump suction ports, and a pool return port; and an angled pool throat extension comprising an input comprising an input plane parallel to the input and an output comprising an output plane parallel to the output, the angled pool throat extension coupled to the pool throat opening, wherein the input plane is not parallel to the output plane;

wherein the pool throat opening comprising a center plane extending vertically through a center of the pool throat opening from a center of the skimmer housing, the pool skimmer further comprising a pool return extending from the pool skimmer housing to a position on a swimming pool wall horizontally offset from the center plane.

21. The pool skimmer of claim 20, wherein the pool throat opening comprising a planar throat opening parallel to the pool throat opening, wherein the planar throat opening and the angled pool throat extension input plane are fixedly coupled and parallel to each other.

22. The pool skimmer of claim 21, further comprising a skimmer pool throat extending between the skimmer housing and the pool throat opening, wherein the planar throat opening is perpendicular to the skimmer pool throat.

* * * * *